US010268158B2

(12) United States Patent
Takagi

(10) Patent No.: US 10,268,158 B2
(45) Date of Patent: Apr. 23, 2019

(54) DRIVE TRANSMISSION DEVICE AND IMAGE FORMING APPARATUS INCORPORATING THE DRIVE TRANSMISSION DEVICE

(71) Applicant: Hiroaki Takagi, Kanagawa (JP)

(72) Inventor: Hiroaki Takagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/704,115

(22) Filed: Sep. 14, 2017

(65) Prior Publication Data

US 2018/0074455 A1 Mar. 15, 2018

(30) Foreign Application Priority Data

Sep. 15, 2016 (JP) ..... 2016-181065

(51) Int. Cl.
*G03G 15/00* (2006.01)
*G03G 21/18* (2006.01)
(Continued)

(52) U.S. Cl.
CPC ..... *G03G 21/186* (2013.01); *G03G 21/1647* (2013.01); *G03G 15/1615* (2013.01);
(Continued)

(58) Field of Classification Search
CPC ..... G03G 21/1633; G03G 2221/1684; G03G 21/1647; G03G 21/1623; G03G 21/1853
(Continued)

(56) References Cited

U.S. PATENT DOCUMENTS

2003/0111779 A1* 6/2003 Morando ..... C23C 2/00 266/233
2011/0283496 A1* 11/2011 Taniguchi ..... A44B 17/0029 24/697.1
(Continued)

FOREIGN PATENT DOCUMENTS

CN 103939487 A 7/2014
CN 104216260 A 12/2014
(Continued)

OTHER PUBLICATIONS

Translation of Matsuda (JP 2014 052618 A) listed in the IDS, publication date:Mar. 20, 2014.*
(Continued)

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

A drive transmission device, which is included in an image forming apparatus, includes an output body, an input body, and an intermediate body. The output body has a drive output portion. The input body has a drive input portion. The intermediate body is supported by a support side body that is one of the output body and the input body. The intermediate body includes a relay portion to receive a driving force applied by the drive output portion and to transmit the driving force to the drive input portion, and a retaining portion to prevent the intermediate body from falling from the support side body. A distance from a center of rotation of the intermediate body to a leading end of the retaining portion is greater than or equal to a distance from the center of rotation of the intermediate body to a leading end of the relay portion.

16 Claims, 24 Drawing Sheets

(51) Int. Cl.
*G03G 21/16* (2006.01)
*G03G 15/16* (2006.01)
*G03G 21/00* (2006.01)

(52) U.S. Cl.
CPC ..... *G03G 15/751* (2013.01); *G03G 15/757* (2013.01); *G03G 21/0094* (2013.01); *G03G 2221/1657* (2013.01)

(58) Field of Classification Search
USPC ..... 399/110
See application file for complete search history.

(56) References Cited

U.S. PATENT DOCUMENTS

2013/0160589 A1* 6/2013 Mittermair ..... F16H 55/06 74/409
2013/0256055 A1* 10/2013 Anderson ..... G01V 1/047 181/121
2014/0270851 A1* 9/2014 Matsuda ..... F16H 1/10 399/167
2014/0356027 A1 12/2014 Yamazaki et al.
2015/0053032 A1 2/2015 Yamazaki et al.
2015/0240879 A1 8/2015 Takagi et al.
2016/0238981 A1 8/2016 Suido et al.

FOREIGN PATENT DOCUMENTS

JP 2014-035040 A 2/2014
JP 2014-052618 3/2014
JP 2014-063082 A 4/2014

OTHER PUBLICATIONS

Office Action for Chinese Patent Application No. 201710788926.5 dated Feb. 26, 2019.

* cited by examiner

DRIVE TRANSMISSION DEVICE AND IMAGE FORMING APPARATUS INCORPORATING THE DRIVE TRANSMISSION DEVICE

CROSS-REFERENCE TO RELATED APPLICATION

This patent application is based on and claims priority pursuant to 35 U.S.C. § 119(a) to Japanese Patent Application No. 2016-181065, filed on Sep. 15, 2016, in the Japan Patent Office, the entire disclosure of which is hereby incorporated by reference herein.

BACKGROUND

Technical Field

This disclosure relates to a drive transmission device and an image forming apparatus incorporating the drive transmission device.

Related Art

Known image forming apparatuses include a drive transmission device that transmits a driving force applied by a drive motor of the apparatus body to a rotary body detachably attached to an apparatus body of the image forming apparatus. The drive transmission device includes an output member mounted on an output shaft on a drive source side, an input member mounted on an input shaft on a rotary body side, and an intermediate member. A driving force is transmitted from the output member to the intermediate member, and then transmitted from the intermediate member to the input member. The intermediate member is tubular, in other words, has a cylindrical shape. The drive transmitting portion of the output member and the drive transmitting portion of the input member are engaged with a relay drive transmitting portion formed in an inner circumferential surface of the intermediate member. The intermediate member is tiltably held to the output member. In a case in which there is axial eccentricity between the output shaft and the input shaft, a tilt of the intermediate member can absorb the axial eccentricity to restrain occurrence of the reaction force.

A known drive transmission device includes a retaining portion provided to the intermediate member so that the retaining portion prevents the intermediate member from coming out from the output member. The retaining portion is disposed projecting from one end of the intermediate member on the opposite side of the input member toward a center of rotation of the intermediate member, and is disposed facing a drive transmitting portion of the output member in the axial direction from the opposite side of the input member. According to this configuration, when the intermediate member abuts against the drive transmitting portion of the output member, the retaining portion can regulate movement of the intermediate member toward the input member. As a result, this configuration can prevent the intermediate member from coming out from the output member from the input member side.

Due to a recent trend of reducing the size of image forming apparatuses, it has been difficult to ensure a sufficient space around a drive transmission device. In order to address this inconvenience, the size of a drive transmission device has been reduced.

The known drive transmission device has the retaining portion that projects closer to the center of rotation than the relay drive transmitting portion, and therefore the diameter of the intermediate member is not reduced sufficiently. Accordingly, the size of the drive transmission device is not reduced.

SUMMARY

At least one aspect of this disclosure provides a drive transmission device including an output body, an input body, and an intermediate body. The output body is disposed on a side of a drive source and has a drive output portion. The input body is disposed on a side of a rotary body and having a drive input portion. The intermediate body has a cylindrical shape and supported by a support side body that is one of the output body and the input body. The intermediate body includes a relay portion and a retaining portion. The relay portion is disposed on an inner circumferential surface of the intermediate body. The relay portion is configured to receive a driving force applied by the drive output portion of the output body and to transmit the driving force to the drive input portion of the input body. The retaining portion is disposed facing a drive transmission portion of the support side body in an axial direction of the intermediate body. The retaining portion is configured to prevent the intermediate body from falling from the support side body. A distance from a center of rotation of the intermediate body to a leading end of the retaining portion is greater than or equal to a distance from the center of rotation of the intermediate body to a leading end of the relay portion.

Further, at least one aspect of this disclosure provides an image forming apparatus including a rotary body and the above-described drive transmission device configured to transmit the driving force from the drive source to the rotary body.

DETAILED DESCRIPTION

Figure 1:
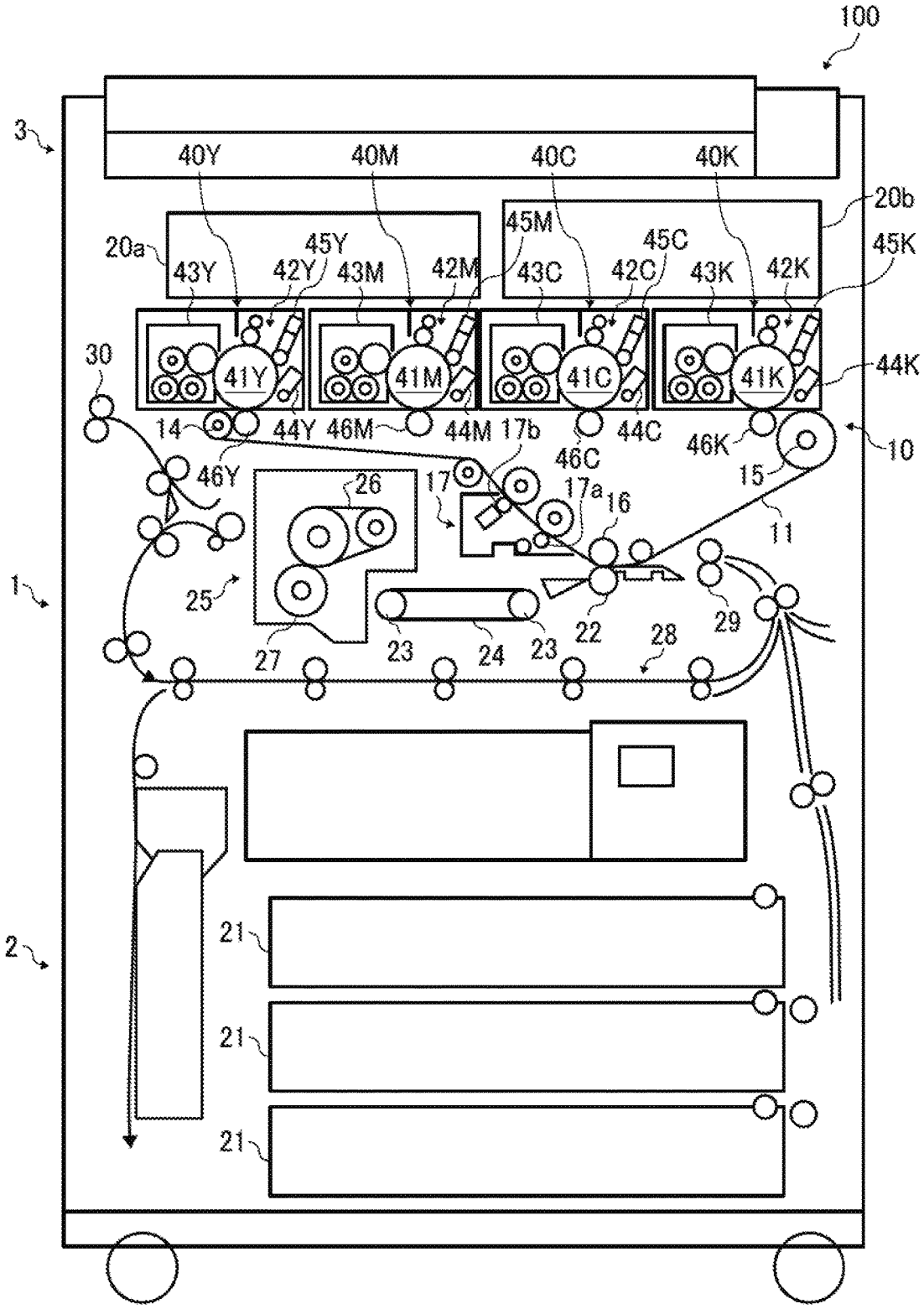
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular towns "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 100 according to an example of this disclosure.

A description is given hereinafter of embodiments where this disclosure is applied to an image forming apparatus 100, for example a copier in the following embodiments. The outline of the image forming apparatus 100 is described first with reference to FIG. 1. The image forming apparatus 100 has the function as what is called a digital color copier that digitizes image information obtained by scanning and reading an original document, and uses the image information to form an image. Further, the image forming apparatus 100, that is, the copier, also has the function of a facsimile machine that sends/receives image data of an original document to/from a remote place, and the function of what is called a copier that prints, on a paper sheet, image information handled by a computer.

It is to be noted that identical parts are given identical reference numerals and redundant descriptions are summarized or omitted accordingly.

The image forming apparatus 100 may be a copier, a facsimile machine, a printer, multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e. printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a diagram illustrating an image forming apparatus 100 according to an embodiment of this disclosure.

In FIG. 1, the image forming apparatus 100 forms an image on a recording sheet in an intermediate transfer system using an intermediate transfer belt 11, and is a tandem system electrophotographic apparatus that forms a toner image of each color with its dedicated process cartridge. A multistage sheet feeder 2 is provided in the lowermost part of the image forming apparatus 100 in the vertical direction. Moreover, an image forming device 1 is provided above the sheet feeder 2, and a scanner 3 is provided further above the image forming device 1. Sheet feed trays 21 store bundles of sheets including plain paper that functions as a recording medium, and recording sheets such as OHP sheets and duplicate originals are respectively arranged in the stages of the sheet feeder 2.

A transfer device 10 is arranged substantially in the middle of the image forming device 1. In the transfer device 10, multiple rollers are arranged inside an endless loop of the intermediate transfer belt 11 so that the intermediate transfer belt 11 is stretched around the multiple rollers. The intermediate transfer belt 11 rotates (the surface of the intermediate transfer belt 11 moves) in a clockwise direction in FIG. 1.

Four process cartridges 40Y, 40M, 40C, and 40K for forming toner images in yellow, magenta, cyan, and black are arranged above the intermediate transfer belt 11 along a direction of movement of the surface of the intermediate transfer belt 11. Since the configurations of the four process cartridges 40Y 40M 40C, and 40K, each functioning as an image forming device, are identical to each other except for the color of toner, the suffixes "Y", "M", "C", and "K" indicating respective colors are omitted below as appropriate.

Moreover, two optical writing units 20*a* and 20*b* as latent image writing units are provided above the four process cartridges 40Y, 40M, 40C, and 40K.

Figure 2:
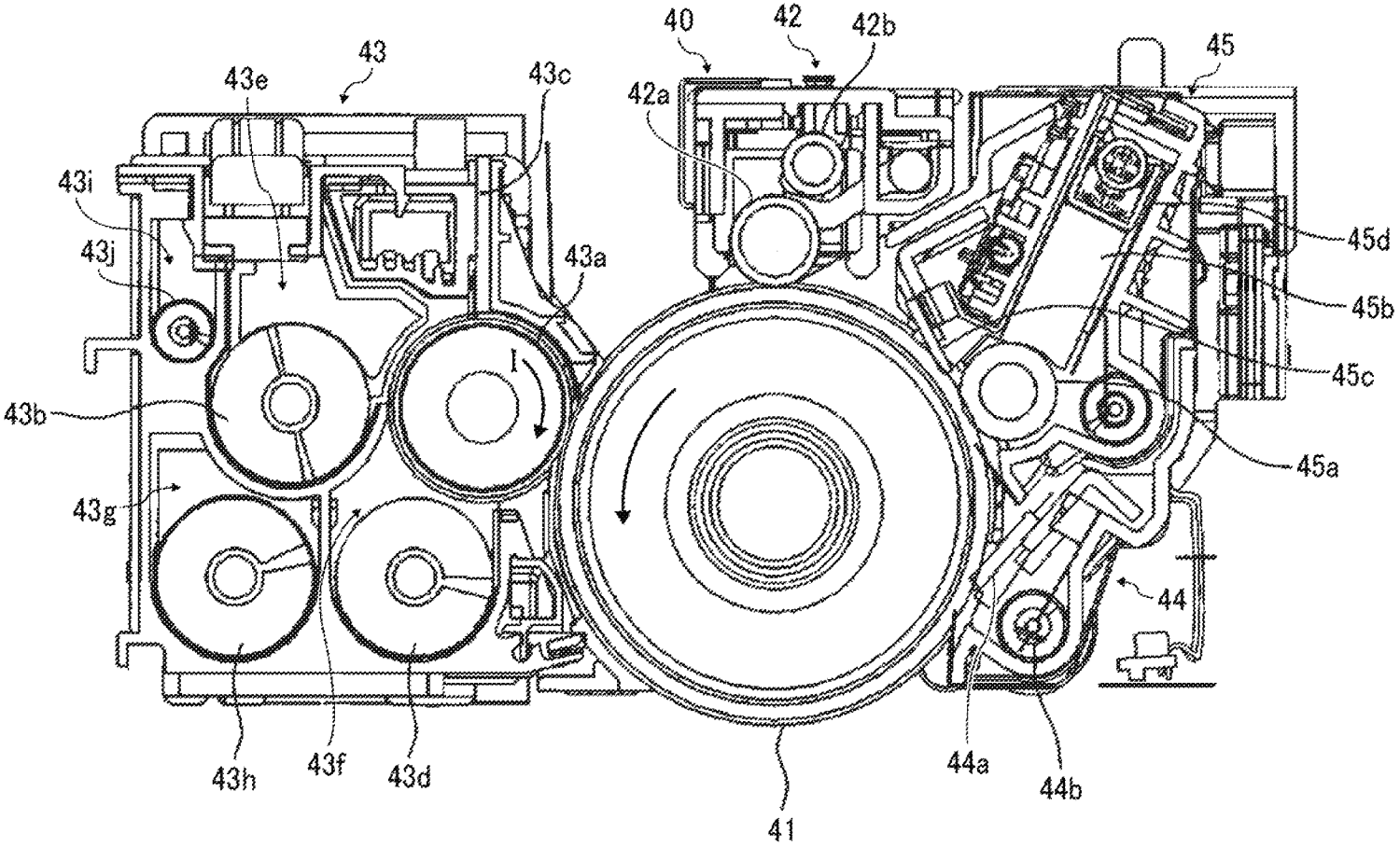
FIG. 2 is an enlarged view illustrating a process cartridge included in the image forming apparatus of FIG. 1.

FIG. 2 is an enlarged view of a configuration of one of the four process cartridges 40Y, 40M, 40C, and 40K of the image forming apparatus 100 according to an embodiment of this disclosure.

Each process cartridge 40 is provided with a drum-shaped photoconductor 41 as a latent image bearer. Each photoconductor 41 is rotatably provided in a counterclockwise direction in FIG. 2. A charging device 42, a developing device 43, and a photoconductor cleaning device 44 are provided around the photoconductor 41.

The charging device 42 mainly includes a charging roller 42*a* and a charging roller cleaner 42*b*. The charging roller 42*a* is arranged to contact the photoconductor 41. The charging roller cleaner 42*b* rotates in contact with the charging roller 42*a*. A charge bias is applied to the charging roller 42*a* to give electrical charge to the surface of the photoconductor 41, so that the surface of the photoconductor 41 is uniformly charged. The charging roller cleaner 42*b* removes adhered substances or foreign materials such as the toner adhered to the surface of the charging roller 42*a*.

The developing device 43 includes a developing roller 43*a* and a developer supply screw 43*b*. The developing roller 43*a* functions as a developer bearer to supply the toner to a latent image on the surface of the photoconductor 41 while moving the surface of the developing device 43 in a direction indicated by arrow I in FIG. 2 and develops the latent image. The developer supply screw 43*b* functions as a supply and transport member to transport a developer from the far side to the near side in a direction orthogonal to the drawing sheet of FIG. 2 while supplying the developer to the developing roller 43*a*. The developer supply screw 43*b* includes a rotating shaft and a blade provided to the rotating shaft. The developer supply screw 43*b* transports the developer in an axial direction of the developer supply screw 43*b* while rotating.

The developing device 43 further includes a development doctor 43*c*, a developer collection screw 43*d*, a supply conveyance passage 43*e*, a collection conveyance passage 43*f*, a stirring conveyance passage 43*g*, and a developer stirring screw 43*h*.

The development doctor 43*c* is provided downstream from an opposing portion between the developing roller 43*a* and the developer supply screw 43*b* in a developing roller surface movement direction. The development doctor 43*c* functions as a developer regulator to regulate the developer on the developing roller 43*a* to a thickness suitable for development.

The developer collection screw 43*d* is provided downstream from a development region in a moving direction of the surface of the developing roller 43*a*. The development region is an opposing region where the developing roller 43*a* and the photoconductor 41 face each other. The developer collection screw 43*d* collects the developer used for development of an image that has passed the development region. The developer collection screw 43*d* collects the developed developer from the developing roller 43*a* and transports the collected developer in the same direction as the developer supply screw 43*b* conveys developer.

The supply conveyance passage 43*e* that accommodates the developer supply screw 43*b* is provided on the side of the developing roller 43*a*.

The collection conveyance passage 43*f* is provided below the developing roller 43*a* in parallel with the developing roller 43*a*. The collection conveyance passage 43*f* functions as a developer collection conveyance passage that accommodates the developer collection screw 43*d*.

The stifling conveyance passage 43*g* stirs and transports the developer in a direction parallel with the collection conveyance passage 43*f* below the supply conveyance passage 43*e*. The stifling conveyance passage 43*g* includes the developer stifling screw 43*h* that stirs the developer and, at the same time, transports the developer toward the far side in FIG. 2, which is an opposite direction to the developer supply screw 43*b*.

The supply conveyance passage 43*e* and the stifling conveyance passage 43*g* are partitioned by a first partition wall. A partitioning part of the first partition wall between the supply conveyance passage 43*e* and the stirring conveyance passage 43*g* has an opening at both ends on the near side and the far side of FIG. 2. The supply conveyance passage 43*e* communicates with the stirring conveyance passage 43*g* via the opening. It is to be noted that, even though both the supply conveyance passage 43*e* and the collection conveyance passage 43*f* are partitioned by the first partition wall, no opening is provided to a partitioning part of the first partition wall between the supply conveyance passage 43*e* and the collection conveyance passage 43*f*. Moreover, two conveyance passages, which are the stirring conveyance passage 43*g* and the collection conveyance passage 43*f*, are partitioned by a second partition wall. The second partition wall has an opening on the near side of FIG. 2. The stirring conveyance passage 43*g* communicates with the collection conveyance passage 43*f* via the opening.

The developer on the developing roller 43*a* is regulated to be thinner by the development doctor 43*c*. The developer is then transported to the development region, which is the facing area between the photoconductor 41 and the developing roller 43*a*, to contribute to development. The developed developer is collected to the collection conveyance passage 43*f*. The developer is then transported from the far side to the near side in the direction perpendicular to the drawing sheet of FIG. 2 to enter the stirring conveyance passage 43*g* through the opening provided in the second partition wall. It is to be noted that the toner is supplied into the stirring conveyance passage 43*g* from a developer supply port provided at an upper part of the stirring conveyance passage 43*g* in the vicinity of the opening of the second partition wall at the upstream end of the stifling conveyance passage 43*g* in the developer conveying direction.

In the supply conveyance passage 43*e* that has received the supply of the developer from the stirring conveyance passage 43*g*, the developer is transported by the developer supply screw 43*b* to the immediate vicinity of the extreme downstream side of the supply conveyance passage 43*e* in the developer conveying direction while being supplied to the developing roller 43*a*.

There is a developer that was supplied to the developing roller 43*a* but not used for development and was transported to the immediate vicinity of the extreme downstream side of the supply conveyance passage 43*e* in the developer conveying direction. Such surplus developer is supplied to the stirring conveyance passage 43*g* through a surplus opening formed in the first partition for the surplus developer.

The collected developer is sent from the developing roller 43*a* to the collection conveyance passage 43*f* and transported by the developer collection screw 43*d* to the immediate vicinity of the extreme downstream side of the collection conveyance passage 43*f* in the developer conveying direction. The collected developer is then supplied to the stirring conveyance passage 43*g* through a collection opening in the second partition wall. While stirring the surplus developer and the collected developer, the developer stirring screw 43*h* transports the supplied surplus developer and the collected developer in the stirring conveyance passage 43*g* to a position in the immediate vicinity of the extreme downstream side of the stirring conveyance passage 43*g* in the developer conveying direction and in the immediate vicinity of the extreme upstream side of the supply conveyance passage 43*e* in the developer conveying direction. The developer transported to this position enters the supply conveyance passage 43*e* through a supply opening in the first partition wall.

In the stirring conveyance passage 43*g*, the collected developer, the surplus developer, and the toner to be supplied from the developer supply ports are stirred and transported by the developer stirring screw 43*h* in the opposite direction to the developer conveying direction in the collection conveyance passage 43*f* and the supply conveyance passage 43*e*. The stirred developer is then carried to the immediate vicinity of the extreme upstream side in the developer conveying direction of the supply conveyance passage 43*e* that communicates in the immediate vicinity of the extreme downstream side in the developer conveying direction.

A toner density sensor is provided substantially immediately below the supply opening in the immediate vicinity of the extreme downstream side of the stirring conveyance passage 43*g* in the developer conveying direction. A toner supply control device is driven in response to an output from the toner density sensor. The toner is then supplied into the stirring conveyance passage 43*g*.

A developer outlet port is provided in the vicinity of an upstream side end of the supply conveyance passage 43*e* in the developer conveying direction (an end portion on a far side in an axial direction of the developing roller 43*a*) so as to communicate the supply conveyance passage 43*e* with a developer output passage 43*i*. It is to be noted that, unless otherwise provided in the specification, the "far side" indicates a back of the image forming apparatus 100.

When an amount of developer conveyed to the upstream side end of the supply conveyance passage 43*e* is greater than a predetermined amount of developer, the developer reaches the height where the developer outlet port is provided. Then, the developer passes through the developer outlet port to be conveyed to the developer output passage 43*i*. The developer that has entered the developer output passage 43*i* is collected by a developer discharge screw 43*j* to an output developer collecting portion 143*c* (see FIG. 3) provided outside the developing device 43. By providing a configuration in which the developer is discharged outside the developing device 43, the developing device 43 can be maintained a constant amount of developer contained therein.

In addition, when a premix toner that includes carrier particles is used to be supplied to the developing device 43, deteriorated carrier particles are discharged to the developer output passage 43*i* together with the toner to change the carrier particles. By so doing, the developer contained in the developing device 43 can be prevented from deterioration.

The photoconductor cleaning device 14 includes a cleaning blade 44*a* and a waste toner output screw 44*b*, and a lubricant applying device 45.

The cleaning blade 14*a* is an elastic member that extends in the rotation axial direction of the photoconductor 41. A side (i.e., a contact side) that extends in a longitudinal direction of the cleaning blade 44*a* functions as an edge portion. The side (the edge portion) is pressed against the surface of the photoconductor 41 to separate and remove adhered substances such as transfer residual toner remaining on the surface of the photoconductor 41. The removed toner is ejected by the waste toner output screw 44*b* to the outside of the photoconductor cleaning device 44.

The lubricant applying device 45 includes a lubricant applying brush roller 45*a* that functions as a lubricant applying brush, a solid lubricant 45*b*, and a regulating blade 45*c*.

The solid lubricant 45*b* is supported by a bracket 45*d* and is pressurized by a pressing member toward the lubricant applying brush roller 45*a*.

The lubricant applying brush roller 45*a* rotates in a direction to be rotated along with the rotation direction of the photoconductor 41. The lubricant applying brush roller 45*a* scrapes the solid lubricant 45*b* to apply the lubricant onto the surface of the photoconductor 41.

A side (i.e., a contact side) of the regulating blade 45*c* that extends in the longitudinal direction thereof functions as an edge portion. The side (the edge portion) is pressed against the surface of the photoconductor 41 so as to regulate the lubricant on the surface of the photoconductor 41.

In FIG. 1, the transfer device 10 includes the intermediate transfer belt 11, a belt cleaning device 17, and four primary transfer rollers 46. The intermediate transfer belt 11 is stretched in a tensioned condition by the multiple rollers including a tension roller 14, a drive roller 15, and a secondary transfer counter roller 16. The intermediate transfer belt 11 is endlessly moved in the clockwise direction in FIG. 1 by the rotation of the drive roller 15 driven by a belt drive motor.

The four primary transfer rollers 46 are arranged to respectively contact an inner circumferential surface side of the intermediate transfer belt 11. A primary transfer bias is applied by a power supply to the primary transfer rollers 46. Moreover, the intermediate transfer belt 11 is pressed by the primary transfer rollers 46 from the inner circumferential surface toward the photoconductors 41 to form respective primary transfer nips. A primary transfer electric field is formed between the photoconductor 41 and the primary transfer roller 46 at each primary transfer nip due to the influence of the primary transfer bias. The toner image formed on the surface of the photoconductor 41 is primarily transferred onto the intermediate transfer belt 11 under the influence of the primary transfer electric field and the nip pressure.

Moreover, the transfer device 10 includes a secondary transfer roller 22. The secondary transfer roller 22 is disposed below the intermediate transfer belt 11 and functions as a secondary transfer body. The secondary transfer roller 22 is pressed against the secondary transfer counter roller 16 via the intermediate transfer belt 11, so that a secondary transfer nip region is formed. The secondary transfer roller 22 then secondarily transfers the toner images on the intermediate transfer belt 11 at one time onto a recording sheet conveyed to the secondary transfer nip region formed between the secondary transfer roller 22 and the intermediate transfer belt 11.

The belt cleaning device 17 is provided downstream from the secondary transfer counter roller 16 in a surface movement direction of the intermediate transfer belt 11. The belt cleaning device 17 includes a belt cleaning brush roller 17*a*. The belt cleaning brush roller 17*a* rotates and removes the residual toner that remains on the surface of the intermediate transfer belt 11 after transfer of the image. Moreover, the belt cleaning device 17 further includes a lubricant applying mechanism, and applies lubricant to the surface of the intermediate transfer belt 11 via a brush roller 17*b* provided to the lubricant applying mechanism.

A fixing device 25 is provided downstream from the secondary transfer roller 22 in a sheet conveyance direction. The fixing device 25 fixes the toner image formed on the recording sheet on the surface of the recording sheet. An endless fixing belt 26 is pressed against a fixing pressure roller 27.

The recording sheet after transfer of the image is conveyed to the fixing device 25 by an endless conveyance belt 24 bridged across a pair of rollers 23.

Moreover, a sheet reversing device 28 is provided below the secondary transfer roller 22 to reverse a recording sheet upon the formation of an image on both the front and back sides of the recording sheet.

When a color original document is copied with the image forming apparatus 100 including the above-described configurations, the scanner 3 reads an image of the color original document placed on an exposure glass. Moreover, the intermediate transfer belt 11 is rotated to form a toner image on each photoconductor 41 by image forming processes employed to the image forming apparatus 100. Then, the toner images formed on the photoconductors 41 are sequentially superimposed to be primarily transferred onto the intermediate transfer belt 11. Accordingly, a four-color superimposed toner image is formed on the intermediate transfer belt 11.

In parallel with the image forming operations of the four single-color toner images being transferred onto the intermediate transfer belt 11, recording sheets are separated and fed, one by one, from a selected one of the sheet feed trays 21 of the sheet feeder 2 toward a pair of registration rollers 29. Then, the separated recording sheet is transported to the registration roller pair 29. The separated and transported recording sheet contacts a nip of the pair of registration rollers 29. By so doing, the conveyance of the recording sheet is temporarily stopped and the recording sheet is being held for standby. The pair of registration rollers 29 resumes the rotation at a proper timing in such a manner as to set the positional relationship between the four-color toner image superimposed on the intermediate transfer belt 11 and a leading end of the recording sheet in predetermined positions. The pair of registration rollers 29 is rotated to convey the standby recording sheet again. Consequently, the secondary transfer roller 22 secondarily transfers the four-color toner image on the intermediate transfer belt 11, to a predetermined position of the recording sheet. Thus, a full color toner image is formed on the recording sheet.

The recording sheet with the full color toner images formed thereon is conveyed to the fixing device 25 that is disposed downstream from the secondary transfer roller 22 in the conveyance passage. The fixing device 25 fixes the full color toner image that has been secondarily transferred by the secondary transfer roller 22 to the recording sheet. The recording sheet with the fixed full color image is ejected by a sheet output roller 30 to the outside of an apparatus body of the image forming apparatus 100.

When a duplex printing mode is selected to form images on both sides of a recording sheet, when the recording sheet having the full color toner image fixed on a first surface thereof is output from the fixing device 25, the recording sheet is conveyed to the sheet reversing device 28 instead of being conveyed to the sheet output roller 30.

After the front and back sides of the recording sheet are reversed by the sheet reversing device 28, the recording sheet is conveyed again to the pair of registration rollers 29. The recording sheet passes through the secondary transfer nip region formed between the secondary transfer roller 22 and the intermediate transfer belt 11 and then through the fixing device 25, so that a full color image is formed on a second surface (the back side) of the recording sheet.

Figure 3:
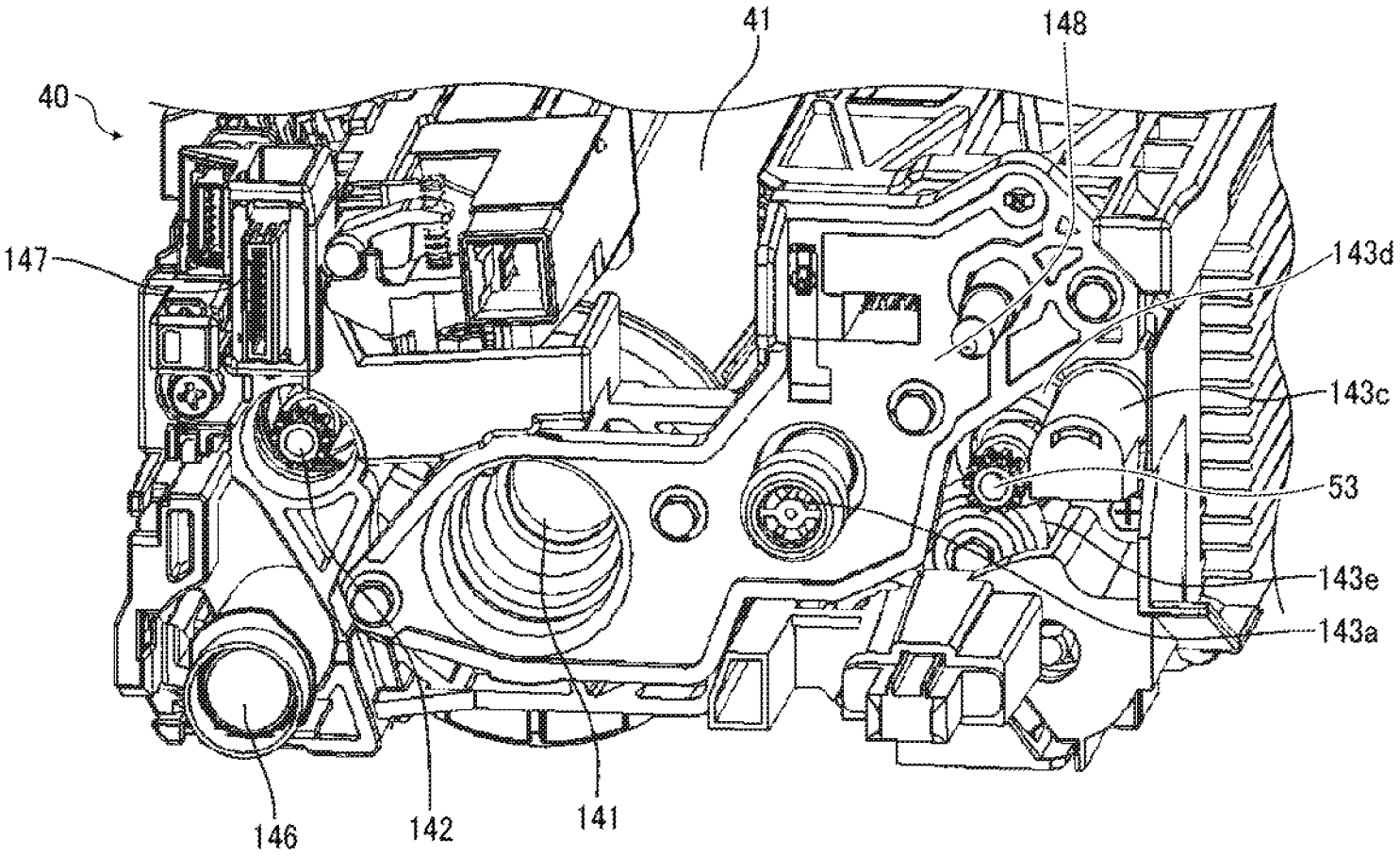
FIG. 3 is a perspective view illustrating a far side of the process cartridge.

FIG. 3 is a perspective view illustrating a far side of the process cartridge 40.

A photoconductor input joint 141 that is mounted on the photoconductor 41 is disposed on the far side of the process cartridge 40. The photoconductor input joint 141 is coupled to a photoconductor output joint that is mounted on the apparatus body of the image forming apparatus 100. A driving force applied by a photoconductor drum motor is transmitted to the photoconductor input joint 141 via the photoconductor output joint, so as to rotate the photoconductor 41.

A developing roller input joint 143*a* of a developing joint is mounted on an end portion on of a shaft of the developing roller 43*a* on the far side of the image forming apparatus 100. A developing roller output joint of the developing joint is mounted on an end portion of the shaft of the developing roller 43*a* on a near side of the image forming apparatus 100. It is to be noted that, unless otherwise provided in the specification, the "near side" indicates a front of the image forming apparatus 100. A developing motor that is provided to the apparatus body of the image forming apparatus 100 applies a driving force to the developing roller output joint of the developing joint, so that the developing roller output joint is rotated. The developing roller input joint 143*a* is drivingly coupled to the developing roller output joint.

A screw input joint 53 of a screw joint 50 is mounted on a shaft of the developer supply screw 43*b*. The screw joint 50 also includes members such as a screw output joint 51 and an intermediate member 52, which are provided to the apparatus body of the image forming apparatus 100. The driving force applied by the developing motor is transmitted to the screw input joint 53 via the members of the screw joint 50, so that the developer supply screw 43*b* is driven to rotate.

A gear 143*d* is mounted on the shaft of the developer supply screw 43*h* to mesh with a collection gear 143*e* that is mounted on a shaft of the developer collection screw 43*d*. The driving force transmitted to the developer supply screw 43*b* is transmitted to the developer collection screw 43*d* via the gear 143*d* and the developer collection screw 43*d*, so that the developer collection screw 43*d* is driven to rotate.

A gear is mounted on an end portion of the shaft of the developer supply screw 43*b* on the near side of the image forming apparatus 100 to mesh with a developer stirring gear that is mounted on a shaft of the developer stirring screw 43*h* and with a developer discharging gear that is mounted on a shaft of the developer discharge screw 43*j*. A driving force that is transmitted to the developer supply screw 43*b* is transmitted to the developer stirring screw 43*h* via the developer stirring gear and the developer discharging gear, so as to rotate the developer stirring screw 43*h* and the developer discharge screw 43*j*, respectively.

A brush roller input joint 142 of a brush roller joint is mounted on an end portion of the lubricant applying brush roller 45*a* on the far side of the image forming apparatus 100. The brush roller joint employs the same joint as the screw joint 50. The driving force applied by a cleaning motor is transmitted to the brush roller input joint 142 via the members of the brush roller joint (i.e., the output joint and the intermediate member) provided to the apparatus body of the image forming apparatus 100. By so doing, the lubricant applying brush roller 45*a* is driven to rotate.

Further, a gear to transmit a driving force to a waste toner output screw 44*b* is disposed on the lubricant applying brush roller 45*a* on the near side of the image forming apparatus 100. The driving force transmitted to the lubricant applying brush roller 45*a* is transmitted to the waste toner output screw 44*b* via the gear, so as to drive to rotate the waste toner output screw 44*b*.

Further, a positioning surface plate 148 is attached on the far side of the process cartridge 40 to position the photoconductors 41 and the developing roller 43*a* such that a development gap between the photoconductor 41 and the developing roller 43*a* is set to a specified gap.

A connector 147 is provided above the brush roller input joint 142 on the far side of the process cartridge 40 to electrically connect the process cartridge 40 to a power source of the apparatus body of the image forming apparatus 100. As the process cartridge 40 is connected to the apparatus body of the image forming apparatus 100, the connector 147 is connected to an apparatus body connector that is provided to the apparatus body of the image forming apparatus 100. By so doing, the process cartridge 40 is electrically connected to the power source of the apparatus body of the image forming apparatus 100. Consequently, the electric power is supplied to the charging device 42 and the developing device 43, so that a charging bias and a developing bias are applied.

Further, an output developer collecting portion 143*c* and a waste toner collecting portion 146 are provided on the far side of the process cartridge 40. The output developer collecting portion 143*c* is where discharged developer conveyed by the developer discharge screw 43*j* is collected. The waste toner collecting portion 146 is where waste toner conveyed by the waste toner output screw 44*b* is collected.

Figure 4:
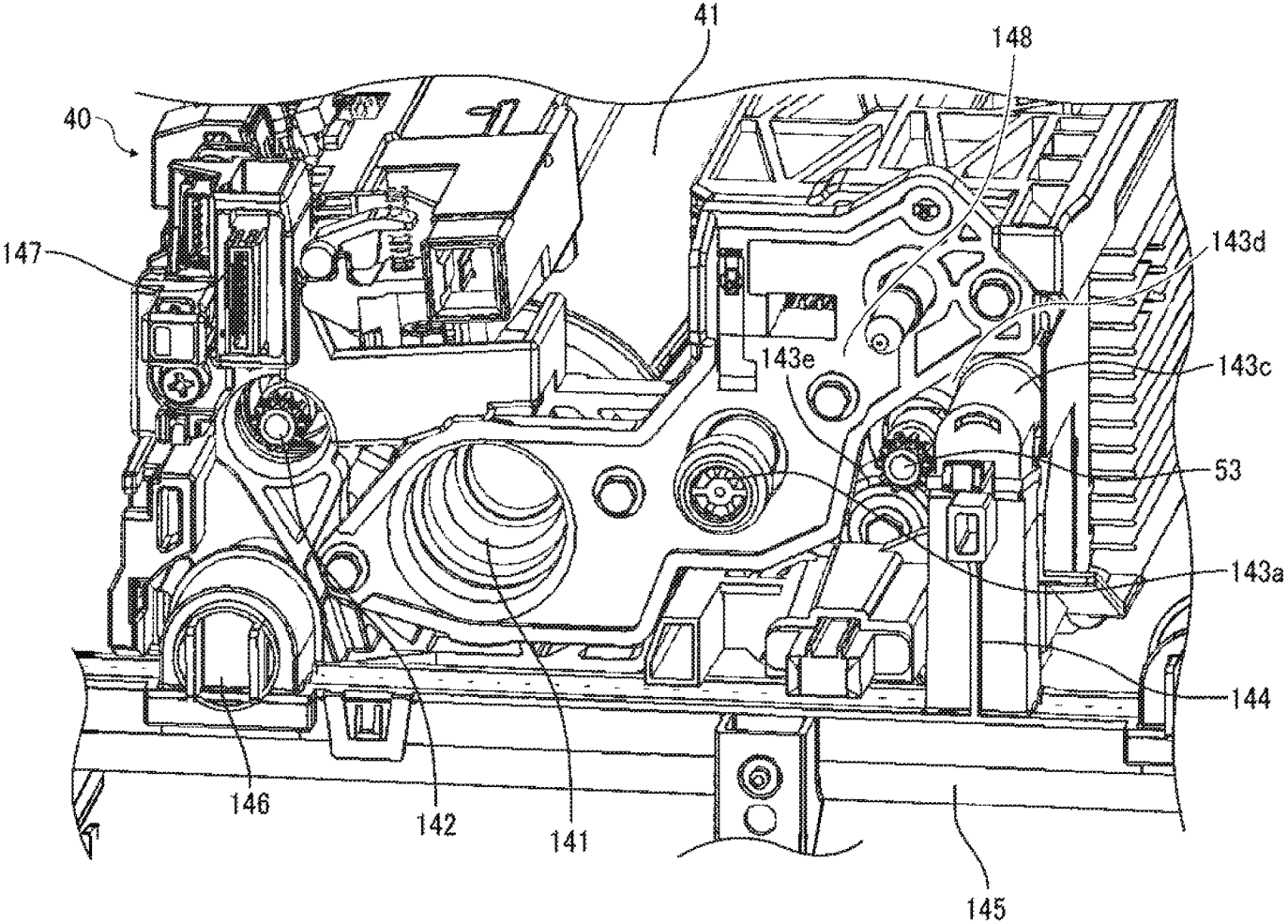
FIG. 4 is a perspective view illustrating the far side of the process cartridge and a waste toner passage provided to an apparatus body of the image forming apparatus.
Figure 5:
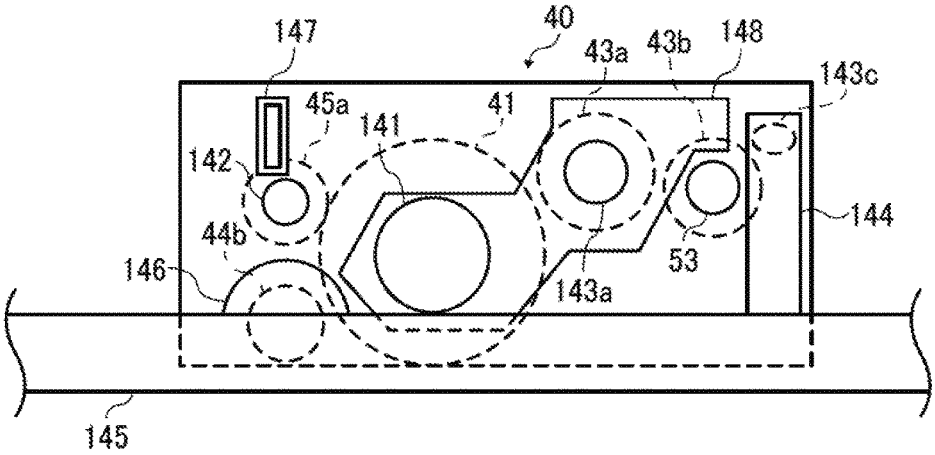
FIG. 5 is a schematic diagram illustrating the far side of the process cartridge and the waste toner passage.

FIG. 4 is a perspective view illustrating the far side of the process cartridge 40 and a waste toner passage 145 provided to the apparatus body of the image forming apparatus 100. FIG. 5 is a schematic diagram illustrating, the fax side of the process cartridge 40 and the waste toner passage 145.

The waste toner passage 145 and an output duct 144 are housed in the apparatus body of the image forming apparatus 100. The waste toner passage 145 includes a developer conveyance screw therein. The output duct 144 has one end that is connected to the waste toner passage 145. An outlet port is formed in a lower the of the output developer collecting portion 143*c*. As the process cartridge 40 is attached to the apparatus body of the image forming apparatus 100, the outlet port is connected to the output duct 144. According to this configuration, the discharged developer that is collected to the output developer collecting portion 143*c* is ejected via the outlet port. Then, the discharged developer passes through the output duct 144 and falls to the waste toner passage 145. Then, the developer conveyance screw disposed inside the waste toner passage 145 conveys the discharged toner to the waste toner storing portion.

Another outlet port is formed in a lower face of the waste toner collecting portion 146. As the process cartridge 40 is attached to the apparatus body of the image forming apparatus 100, the outlet port is connected to the waste toner passage 145. According to this configuration, the waste toner collected to the waste toner collecting portion 146 fills from the outlet port to the waste toner passage 145. Then, the developer conveyance screw disposed inside the waste toner passage 145 conveys the waste toner to the waste toner collecting portion 146.

As illustrated in FIGS. 4 and 5, the positioning surface plate 148, the output developer collecting portion 143*c*, and the output duct 144 are disposed around the screw input joint 53, and therefore no extra space can be spared sufficiently around the screw input joint 53. Further, the connector 147 and the waste toner collecting portion 146 are disposed around the brush roller input joint 142, and therefore no extra space can be spared sufficiently around the brush roller input joint 142. Accordingly, it is preferable to provide a joint having a smaller outer diameter to function as a screw joint to drivingly couple the apparatus body of the image forming apparatus 100 and the developer supply screw 43*b* and as a brush roller joint to drivingly couple the apparatus body of the image forming apparatus 100 and the lubricant applying brush roller 45*a*.

Further, "axis alignment" or "angular misalignment" may occur due to manufacturing errors or assembly errors. The "axis misalignment" is a misalignment in which an axial center of the developer supply screw 43*b* is displaced from an axial center of the screw output joint 51 and the "angular misalignment" is a misalignment in which an axial center of one of the developer supply screw 43*b* and the screw output joint 51 is displaced from an axial center of the other of the developer supply screw 43*b* and the screw output joint 51.

For example, in a case in which a joint includes one external gear and one internal gear, when axis misalignment occurs, the position of tooth or teeth of the gears shifts in a direction of the axis misalignment in comparison with a case with no axis misalignment. As a result, the contact pressure of the teeth of the external gear and the teeth of the internal gear increases at a position where the shaft of the joint is rotated by 90 degrees in the direction of the axis misalignment and decreases at a position where the shaft of the joint is rotated by 90 degrees in an opposite direction to the direction of the axis misalignment. Due to the above-described imbalance of force, if axis misalignment occurs, a reaction force is generated to the screw joint when a driving force is transmitted in the joint.

The reaction force generated at the joint is applied to the shaft of the developing roller 43*a* via a developing casing that rotatably supports the developer supply screw 43*b* and the developing roller 43*a*. As a result, the developing roller 43*a* approaches or separates from the photoconductor 41 due to the reaction force generated at the screw joint. Accordingly, the development gap between the photoconductor 41 and the developing roller 43*a* changes. According to this configuration, it is likely to generate uneven image density at a rotation period of the screw joint.

Further, when angular misalignment occurs, the rotation speed of the developer supply screw 43*b* varies periodically, and therefore the amount of developer supply to the developing roller 43*a* changes. Consequently, it is likely that development nonuniformity occurs.

In addition, if a reaction force having one cycle in one rotation of the brush roller joint is applied at the brush roller joint due to the axis misalignment, the contact pressure of the lubricant applying brush roller 45*a* to the photoconductor 41 changes to cause periodic variations of the load torque of the photoconductor 41. As a result, the rotation period of the photoconductor 41 varies at the rotation period of the brush roller joint. Therefore, it is likely that nonuniformity occurs in image density at the rotation period of the brush roller joint. Further, when angular misalignment occurs, the rotation speed of the lubricant applying brush roller 45*a* varies periodically. Accordingly, the rotation speed of the lubricant applying brush roller 45*a* varies the load torque of the photoconductor 41 periodically. Consequently, it is likely that the periodic variations occurs to the rotation speed of the photoconductor 41.

Accordingly, it is preferable to provide a joint that absorbs axial misalignment and angular misalignment and restrains occurrence of a reaction force to function as a screw joint or a brush roller joint.

As described above, in the present embodiment, it is preferable to provide a compact joint that restrains occurrence of a reaction force to function as a screw joint or a brush roller joint. In the present embodiment, the following joint is employed as a screw joint or a brush roller joint. The following description is given of a screw joint. It is to be noted, however, that the screw joint described below has a configuration basically identical to the configuration of a brush roller joint.

Figure 6:
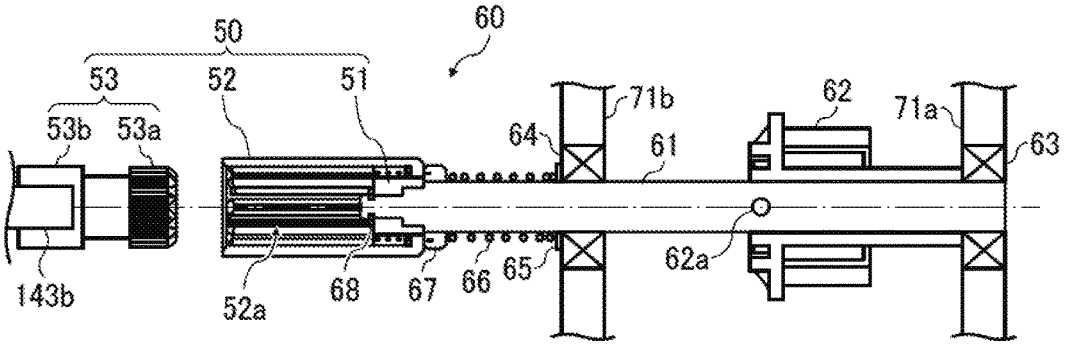
FIG. 6 is a schematic view illustrating a screw drive transmission device.
Figure 7:
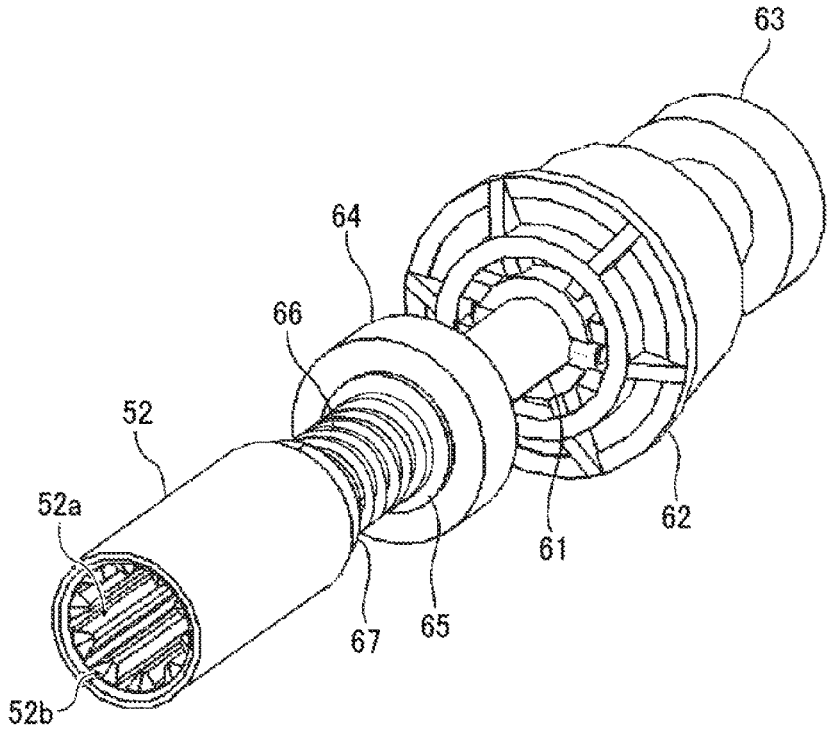
FIG. 7 is a perspective view illustrating the screw drive transmission device on a side close to the apparatus body of the image forming apparatus.

FIG. 6 is a schematic view illustrating a configuration of a screw drive transmission device 60 that transmits a driving force applied by the developing motor to the developer supply screw 43*b*. The left side of FIG. 6 corresponds to a near side of the screw drive transmission device 60. The right side of FIG. 6 corresponds to a far side of the screw drive transmission device 60, inside which a chive device is disposed. FIG. 7 is a perspective view illustrating the screw drive transmission device 60 on a side close to the apparatus body of the image forming apparatus 100.

The screw drive transmission device 60 includes a drive output shaft 61 having a diameter (φ) of 6 mm. The drive output shaft 61 is driven to rotate by a driving force applied by the developing motor. The drive output shaft 61 is rotatably supported by a first side plate 71*a* and a second side plate 71*b* included in the apparatus body of the image forming apparatus 100 via a first bearing 63 and a second bearing 64. A drive gear 62 is disposed between the first side plate 71*a* and the second side plate 71*b* of the drive output shaft 61 to rotate together with the drive output shaft 61 as a single unit. The driving force applied by the developing motor is transmitted to the drive gear 62 via multiple idler gears. Specifically, by fitting the drive gear 62 to a parallel pin 62*a* mounted on the drive output shaft 61, the drive gear 62 rotates with the drive output shaft 61 as a single unit.

The screw joint 50 includes the screw output joint 51, the intermediate member 52, and the screw input joint 53. The screw output joint 51 is an output member that is mounted on the end portion of the drive output shaft 61 on the near side of the image forming apparatus 100. The screw input joint 53 is an input member that is mounted on the end portion of the shaft of the developer supply screw 43*b* that functions as a rotary body, on the far side of the image forming apparatus 100. The intermediate member 52 is supported by the screw input joint 53. The screw output joint 51, the intermediate member 52, and the screw input joint 53 include resin materials. Specifically, the screw output joint 51 and the screw input joint 53 include polyphenylene sulfide (PPS) and the intermediate member 52 includes polyacetal (POM).

A spring 66 and a ring shaped slide member 67 are disposed between the screw output joint 51 and the second bearing 64. The slide member 67 is slidable in the axial direction of the drive output shaft 61. An end portion of the spring 66 on the far side of the image forming apparatus 100 contacts a spring bearing 65 that is disposed at the second bearing 64 on the near side of the image forming apparatus 100. An end portion of the spring 66 on the near side of the image forming apparatus 100 contacts the slide member 67 to bias the slide member 67 toward the spring 66 on the near side of the image forming apparatus 100. The slide member 67 abuts against the end portion of the screw output joint 51 on the far side of the image forming apparatus 100 to regulate movement of the slide member 67 toward the near side of the image forming apparatus 100.

Figure 8:
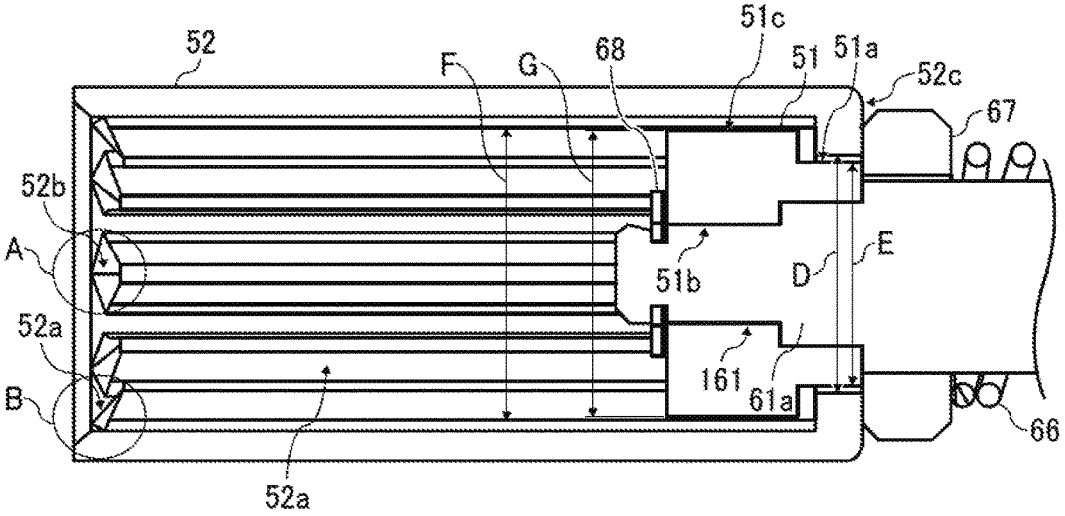
FIG. 8 is an enlarged view illustrating an end portion of a near side of a drive output shaft.

FIG. 8 is an enlarged view illustrating the end portion of the drive output shaft 61 on the near side of the image forming apparatus 100.

A joint attaching portion 61*a* is formed at the drive output shaft 61 on the near side of the image forming apparatus 100 (i.e., at the side near the process cartridge 40 or at the left side of FIG. 8). The joint attaching portion 61*a* has a diameter smaller than the diameter of the drive output shaft 61. A cross section of the joint attaching portion 61*a* on the near side of the image forming apparatus 100 in an axial (vertical) direction is a rectangle shape with rounded corners, in other words, includes a pair of arc portions (circumferential surface portions) and a pair of straight lines facing in parallel with each other (flat portions).

Figure 9:
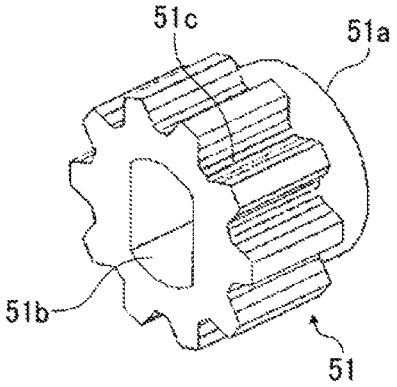
FIG. 9 is a perspective view illustrating a screw output joint.

FIG. 9 is a perspective view illustrating the screw output joint 51.

The screw output joint 51 includes a tubular portion 51*a*, a drive receiving portion 51*b*, and an output external gear 51*c*. The output external gear 51*c* functions as a drive transmitting portion. The drive receiving portion 51*b* has an opening of a rectangle shape with rounded corners. The screw output joint 51 is inserted into the drive output shaft 61 from the near side of the image forming apparatus 100 to fit the tubular portion 51*a* to a round portion of the joint attaching portion 61*a*, so that the drive receiving portion 51*b* is fitted to a rounded rectangle cross section 161 of the joint attaching portion 61*a*. By so doing, as illustrated in FIG. 8, the screw output joint 51 is attached to the drive output shaft 61 such that the screw output joint 51 rotates together with the drive output shaft 61 as a single unit.

Figure 10:
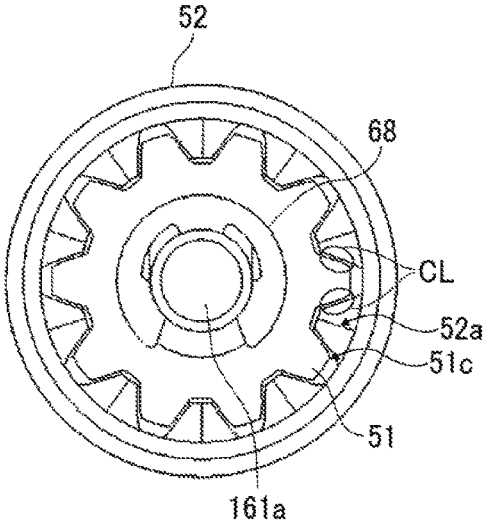
FIG. 10 is a front view illustrating the screw drive transmission device on the side of the apparatus body, viewed from the near side.

FIG. 10 is a front view illustrating the screw drive transmission device 60 on the side of the apparatus body of the image forming apparatus 100, viewed from the near side of the image forming apparatus 100.

As illustrated in FIG. 10, a near side leading end 161*a* of the drive output shaft 61 has a cylindrical shape with grooves on an outer circumferential surface thereof. The near side leading end 161*a* has a diameter corresponding to a lateral length of the rounded rectangle cross section 161 of the joint attaching portion 61*a*. By fitting an E ring 68 to the groove, the E ring 68 prevents the screw output joint 51 from coming out from the end portion of the drive output shaft 61 on the near side of the image forming apparatus 100. That is the E ring 68 functions as a retaining portion of the screw output joint 51.

Figure 11:
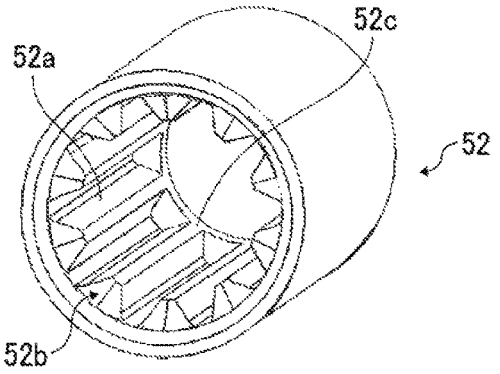
FIG. 11 is a perspective view illustrating an intermediate member.

FIG. 11 is a perspective view illustrating the intermediate member 52.

The intermediate member 52 is a tubular member having an outer diameter of 12 mm that is twice as long as the diameter of the chive output shaft 61, and includes an internal gear 52*a* and a retaining portion 52*c*. The internal gear 52*a* that functions as a relay drive transmitting portion is disposed on an inner circumferential surface of the intermediate member 52. The retaining portion 52*c* is disposed at an end portion of the intermediate member 52 on the far side of the image forming apparatus 100 to prevent the intermediate member 52 from coming out from the screw output joint 51.

The intermediate member 52 is inserted from an end portion of the drive output shaft 61 on the far side of the image forming apparatus 100 before the drive output shaft 61 is fitted to the first side plate 71*a* and the second side plate 71*b*. Then, the internal gear 52*a* of the intermediate member 52 is meshed with the output external gear 51*c* of the screw output joint 51 that is attached to the end portion of the drive output shaft 61 of the image forming apparatus 100. By meshing the internal gear 52*a* with the output external gear 51*c*, as illustrated in FIG. 8, the retaining portion 52*c* is brought to face the output external gear 51*c*. Accordingly, the intermediate member 52 can be prevented from being come out from the screw output joint 51, and therefore can be supported by the screw output joint 51.

After the internal gear 52*a* has been meshed with the output external gear 51*c*, the slide member 67, the spring 66, the spring bearing 65, the second bearing 64, and the first bearing 63 are fitted in this order from the end portion of the drive output shaft 61 on the far side of the image forming apparatus 100. Then, the second bearing 64 is fitted to the second side plate 71*b*, the first bearing 63 is fitted to the first side plate 71*a*, and the drive output shaft 61 is attached to the apparatus body of the image forming apparatus 100.

As illustrated in FIG. 11, a tapered portion 52*b* is formed at an end portion of each internal tooth of the internal gear 52*a* on the near side of the image forming apparatus 100. The tapered portion 52*b* tilts from the near side toward the far side of the image forming apparatus 100 in a direction of diameter of the intermediate member 52 and a rotational direction of the intermediate member 52. Specifically, as can be seen from an area A surrounded by a circle in FIG. 8, the tooth thickness of the internal gear 52*a* gradually increases toward the far side of the image forming apparatus 100 and, as can be seen from an area B surrounded by a circle in FIG. 8, the tooth depth of the internal gear 52*a* gradually increases toward the far side of the image forming apparatus 100.

In the present embodiment, the intermediate member 52 is axially tilted and is supported by the screw output joint 51 to be slidable in the axial direction of the intermediate member 52. Specifically, as illustrated in FIG. 8, an inner diameter D of the retaining portion 52*c* is longer or greater than an outer diameter F of the tubular portion 51*a* of the screw output joint 51 that is disposed facing the retaining portion 52*c*, and the retaining portion 52*c* is disposed facing the tubular portion 51*a* of the screw output joint 51 with a predetermined gap. Further, the internal gear 52*a* is extended straight in the axial direction thereof. Further, a clearance corresponding a gap between the tooth bottom of the internal gear 52*a* and the tooth tip of the output external gear 51*c* (the length of the gap=a tooth bottom circle diameter F of the internal gear 52*a*−a tooth tip circle diameter G of the output external gear 51*c*) and a play (backlash) in the rotational direction of the screw joint 50 between an internal tooth of the internal gear 52*a* and an external tooth of the output external gear 51*c*, as illustrated in areas CL, each surrounded by a circle in FIG. 10 are set so that the intermediate member 52 can tilt by a predetermined angle. Accordingly, the intermediate member 52 is supported by the screw output joint 51 to be tiltable by the predetermined angle and movable in the axial direction of the intermediate member 52.

Figure 12:
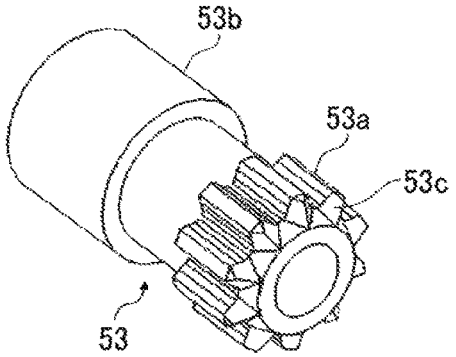
FIG. 12 is a perspective view illustrating a screw input joint.

FIG. 12 is a perspective view illustrating the screw input joint 53.

The screw input joint 53 includes an attaching portion 53*b* and an input external gear 53*a*. The attaching portion 53*b* is attached to a shaft 143*b* of the developer supply screw 43*b*. The attaching portion 53*b* has an opening having a rectangle shape with rounded corners. The leading end of the shaft 143*b* of the developer supply screw 43*b* on the far side of the image forming apparatus 100 has a rectangle shape with rounded corners in vertical cross section in the axial direction of the developer supply screw 43*b*. By inserting the leading end of the shaft 143*b* of the developer supply screw 43*b*, on the far side of the image forming apparatus 100, having the rectangle shape with rounded corners into the opening of the attaching portion 53*b*, the screw input joint 53 is mounted on the shaft 143*b* of the developer supply screw 43*b* so that screw input joint 53 rotates together with the shaft 143*b* of the developer supply screw 43*b*.

A tapered portion 53*c* is formed at an end portion of each external tooth of the input external gear 53*a* on the far side of the image forming apparatus 100. The tapered portion 53*c* is the same as the tapered portion 52*b* formed on the internal tooth of the intermediate member 52. Specifically, the tooth thickness of the input external gear 53*a* gradually increases toward the far side of the image forming apparatus 100 and the tooth depth of the input external gear 53*a* gradually increases toward the far side of the image forming apparatus 100.

Figure 13A:
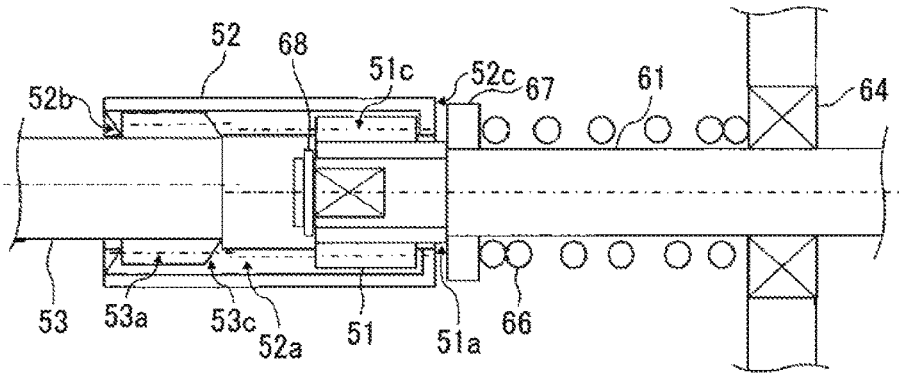
FIG. 13A is a schematic diagram illustrating a state in which the intermediate member and the screw input joint are drivingly coupled with each other.
Figure 13B:
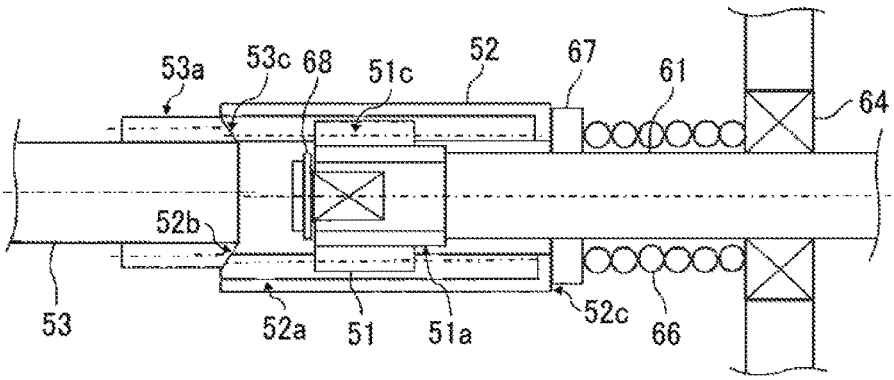
FIG. 13B is a schematic diagram illustrating a state in which the process cartridge is inserted in the apparatus body while the intermediate member and the screw input joint are not drivingly coupled with each other.

FIG. 13A is a schematic diagram illustrating a state in which the intermediate member 52 and the screw input joint 53 are drivingly coupled with each other. FIG. 13B is a schematic diagram illustrating a state in which the process cartridge 40 is inserted in the apparatus body of the image forming apparatus 100 while the intermediate member 52 and the screw input joint 53 are not drivingly coupled with each other.

At installation of the process cartridge 40 to the apparatus body of the image forming apparatus 100, when the external tooth of the screw input joint 53 contacts the internal tooth of the intermediate member 52 in the axial direction of the screw input joint 53 and the intermediate member 52, the input external gear 53*a* of the screw input joint 53 is not inserted into the intermediate member 52, and therefore the intermediate member 52 and the screw input joint 53 are not likely to be drivingly coupled with each other. In this case, as illustrated in FIG. 13B, the intermediate member 52 presses the slide member 67 toward the far side of the image forming apparatus 100. As the intermediate member 52 presses the spring 66, the intermediate member 52 is moved toward the far side (to the right side of FIG. 13B) of the image forming apparatus 100 together with the slide member 67. By so doing, even when the intermediate member 52 and the screw input joint 53 are not drivingly coupled with each other, the process cartridge 40 can be attached to the apparatus body of the image forming apparatus 100.

After the intermediate member 52 that is driven by the developing motor rotates together with the screw output joint 51, the internal teeth of the intermediate member 52 are located between respective the external teeth of the input external gear 53*a*. Then, the tip of a tooth of the internal gear 52*a* and the tip of a tooth of the input external gear 53*a* collide with each other and then slip relative to each other, and the intermediate member 52 moves to the near side (the left side of FIG. 13B) of the image forming apparatus 100 by the biasing force applied by the spring 66. Due to this action, as illustrated in FIG. 13A, the input external gear 53*a* is inserted into the intermediate member 52, so that the input external gear 53*a* and the internal gear 52*a* are brought to be meshed with each other. As a result, the intermediate member 52 and the screw input joint 53 are drivingly coupled with each other. Then, the driving force is transmitted from the intermediate member 52 to the screw input joint 53.

In the present embodiment, the tapered portion 52*b* is provided at the end portion of each internal tooth of the internal gear 52*a* of the intermediate member 52 on the near side of the image forming apparatus 100 and the tapered portion 53*c* is provided at the end portion of each external tooth of the input external gear 53*a* of the screw input joint 53 on the far side of the image forming apparatus 100. In a case in which the rotation phase of the internal tooth of the internal gear 52*a* of the intermediate member 52 and the rotation phase of the external tooth of the input external gear 53*a* of the screw input joint 53 are substantially matched, the tapered portion 52*h* of the internal teeth contacts the tapered portion 53*c* of the external teeth of the input external gear 53*a*. As described above, the tapered portions 52*b* and 53*c* tilt to the rotational direction of the intermediate member 52. Therefore, with guidance of the tapered portions 52*b* and 53*c*, the input external gear 53*a* can be meshed with the internal gear 52*a* smoothly.

Further, for example, there may be a case that the center of the end portion of the intermediate member 52 on the near side of the image forming apparatus 100 and the center of the end portion of the screw input joint 53 on the far side of the image forming apparatus 100 are shifted due to axis misalignment, angular misalignment, and inclination of the intermediate member 52 to the axial direction of the intermediate member 52 along with the aid of gravity. Each of the tapered portion 52*b* and the tapered portion 53*c* is also tilted to the axial direction of the intermediate member 52, the angle of inclination of the intermediate member 52 to the axial direction of the intermediate member 52 is adjusted so that the input external gear 53*a* of the screw input joint 53 can be inserted into the intermediate member 52 by each of the tapered portion 52*b* and the tapered portion 53*c*. As a result, even when there are axis misalignment, angular misalignment, and inclination of the intermediate member 52 to the axial direction of the intermediate member 52 along with the aid of gravity, the input external gear 53*a* of the screw input joint 53 can be inserted into the intermediate member 52. By so doing, even when there are axis misalignment, angular misalignment, and inclination of the intermediate member 52 to the axial direction of the intermediate member 52 along with the aid of gravity, the intermediate member 52 and the screw input joint 53 can be drivingly coupled with each other.

In the present embodiment, the intermediate member 52 can tilt at a predetermined angle to the axial direction of the intermediate member 52 by appropriately setting a gap (backlash and clearance) between the internal gear 52*a* and the output external gear 51*c*, a gap (backlash and clearance) between the internal gear 52*a* and the input external gear 53*a*, and a gap between the retaining portion 52*c* and the tubular portion 51*a* of the screw output joint 51. Therefore, when there is axis misalignment between the drive output shaft 61 and the shaft 143*b* of the developer supply screw 43*b*, by causing the intermediate member 52 to tilt, generation of a portion of high contact pressure or low contact between adjacent teeth in the axial direction of the intermediate member 52 can be prevented. Accordingly, unbalanced force can be prevented, and therefore occurrence of the reaction force can be restrained.

Further, by providing the intermediate member 52, when angular misalignment occurs, the intermediate member 52 tilts at a predetermined angle to the screw output joint 51, so that the intermediate member 52 tilts at the angle to the screw input joint 53 that is the same angle to the screw output joint 51. By so doing, speed fluctuation that occurs during drive transmission from the screw output joint 51 to the intermediate member 52 is canceled by speed fluctuation that occurs during drive transmission from the intermediate member 52 to the screw input joint 53. Accordingly, even when angular misalignment occurs, the speed fluctuation of rotations of the developer supply screw 43*b* can be restrained.

Further, as the intermediate member 52 and the screw input joint 53 move to a drive coupling position at which the intermediate member 52 and the screw input joint 53 are drivingly coupled with each other, the slide member 67 contacts against an end portion of the tubular portion 51*a* of the screw output joint 51. Due to this action, when the intermediate member 52 is located at the drive coupling position, the biasing force of the spring 66 does not affect the intermediate member 52. As a result, the intermediate member 52 moves smoothly, and therefore angular misalignment and angular misalignment can be absorbed preferably.

Alternatively, the slide member 67 can be removed from the configuration. Therefore, when the end portion of the spring 66 on the near side of the image forming apparatus 100 directly contacts the intermediate member 52 to locate the intermediate member 52 at the drive coupling position, the biasing force of the spring 66 does not affect the intermediate member 52. Accordingly, the configuration of the present embodiment can reduce the number of parts, and therefore can reduce the cost and size of the image forming apparatus 100.

By contrast, since the screw joint 50 is made to be disposed within a small space, the outer diameter of the intermediate member 52 is made to be not more than twice the diameter of the drive output shaft 61 (6 mm), so as to achieve a reduction in size of the screw joint 50. As a result of a reduction in size of the screw joint 50, it becomes difficult to make the tubular portion 51*a* have a thickness that can reliably contact the end portion of the spring 66 on the near side of the image forming apparatus 100. Therefore, it is likely that the spring 66 moves over the tubular portion 51*a* to contact the retaining portion 52*c* of the intermediate member 52 that is located at the drive coupling position and that the biasing force of the spring 66 remains affecting the intermediate member 52 located at the drive coupling position.

By contrast, in the present embodiment, the slide member 67 is disposed between the tubular portion 51*a* and the spring 66. Due to this action, when the intermediate member 52 is located at the drive coupling position, the biasing force of the spring 66 does not affect the intermediate member 52 reliably even with the joint (i.e., the screw joint 50) that is made smaller in size.

Alternatively, when the intermediate member 52 is located at the drive coupling position, the spring 66 is made to have a free length. By so doing, when the slide member 67 is removed and the intermediate member 52 is located at the drive coupling position, the biasing force of the spring 66 may not be affected to the intermediate member 52. However, this case is not preferable because it is likely that the intermediate member 52 cannot be moved to the drive coupling position by the biasing force of the spring 66.

Further, it is preferable that the external teeth of the output external gear 51*c* and the external teeth of the input external gear 53*a* have a crowing shape.

Figure 14:
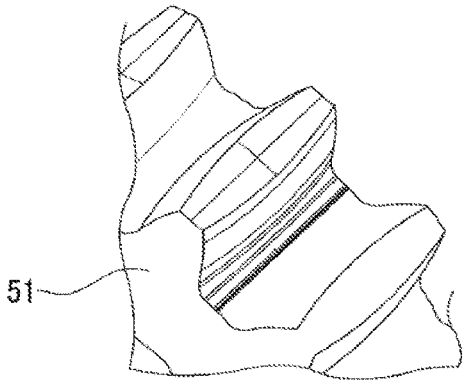
FIG. 14 is a perspective view illustrating an example of an external tooth having a crowning shape in the output external gear.

FIG. 14 is a perspective view illustrating an example of an external tooth having a crowning shape in the output external gear 51*c*.

The crowing shape is a shape of a tooth having a crowing shape in a direction of thickness of the tooth. Specifically, as illustrated in FIG. 14, the thickness of a tooth of the output external gear 51*c* at the center is die maximum tooth thickness and the thickness of the tooth of the output external gear 51*c* at both ends in a tooth width is the minimum thickness. The teeth of the input external gear 53*a* have the crowing shape as the tooth of the output external gear 51*c* illustrated in FIG. 14.

The teeth of the output external gear 51*c* and the teeth of the input external gear 53*a* are designed to have the crowing shape having the thickness changed in a direction of a pitch circle, so as to mesh with the internal gear 52*a* of the intermediate member 52 at a regulated effective tooth face (the center in the tooth width). By forming the external teeth of the output external gear 51*c* and the external teeth of the input external gear 53*a* to the crowing shape, the external tooth contacts the internal tooth on a curved surface. Therefore, the intermediate member 52 can be inclined smoothly, axis misalignment and angular misalignment can be absorbed preferably, and the reaction force can be reduced.

In a case in which the intermediate member 52 is drivingly coupled with the screw input joint 53 while being tilted to the axial direction of the intermediate member 52, the external teeth of the output external gear 51*c* and the external teeth of the input external gear 53*a* slide on the internal teeth of the intermediate member 52 at rotation driving, and therefore both the external teeth and the internal teeth become abrasion. When the external teeth of the output external gear 51*c* and the external teeth of the input external gear 53*a* have the crowing shape, if the external teeth become worn, the external teeth that have contacted the curved surface of the internal teeth come to contact a flat surface of the internal teeth. As a result, the intermediate member 52 can hardly be inclined, and therefore it is likely that the effect of prevention of the reaction force are reduced.

Generally, a joint having a larger Young's modulus is harder and more difficult to wear than other joints. Therefore, it is preferable to set Young's modulus of the screw output joint 51 and Young's modulus of the screw input joint 53 to be greater than Young's modulus of the intermediate member 52. By making Young's modulus of the screw output joint 51 and Young's modulus of the screw input joint 53 greater than Young's modulus of the intermediate member 52, the intermediate member 52 can be made more difficult to wear. By so doing, the crowing shape of the external teeth of the output external gear 51*c* and the external teeth of the input external gear 53*a* can be maintained over a long period, and the intermediate member 52 can be tilted smoothly over a long period. Accordingly, an effect of restrain of the reaction force can be maintained over a long period.

Further, the intermediate member 52 may be supported by the screw input joint 53 disposed on the side of the process cartridge 40. However, it is preferable that the intermediate member 52 is supported by the screw output joint 51 disposed on the side of the apparatus body of the image forming apparatus 100, as described in the present embodiment. When the intermediate member 52 is supported by the screw input joint 53 on the side of the process cartridge 40, the number of parts of the process cartridge 40 increases, which leads to an increase in cost of the process cartridge 40. The process cartridge 40 is a consumable supply and needs regular replacement. Therefore, it is likely that an increase in cost of the process cartridge 40 leads to an increase in cost of maintenance of the image forming apparatus 100. Therefore, when the intermediate member 52 is supported by the screw output joint 51 that is disposed on the side of the apparatus body of the image forming apparatus 100, as described in the present embodiment, an increase in cost of the process cartridge 40 can be restrained, and therefore the cost of maintenance of the image forming apparatus 100 can also be restrained.

Figure 15:
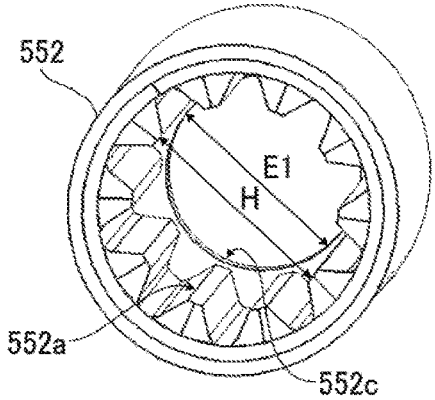
FIG. 15 is a perspective view illustrating a comparative intermediate member according to a comparative example.
Figure 16:
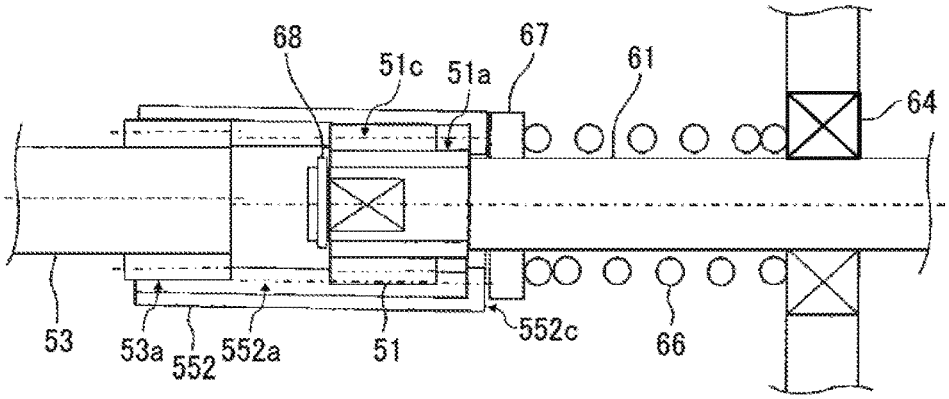
FIG. 16 is a diagram illustrating the comparative intermediate member according to the comparative example.

FIG. 15 is a perspective view illustrating a comparative intermediate member 552 according to a comparative example. FIG. 16 is a diagram illustrating the comparative intermediate member 552 according to the comparative example.

As illustrated in FIG. 15, the comparative intermediate member 552 has a tubular portion 551*a* and includes an internal gear 552*a* and a retaining member 552*c*. The retaining member 552*c* has an inner diameter E1 that is shorter than a tooth tip circle diameter H of the internal gear 552*a*, so that the retaining member 552*c* projects toward the center of rotation farther than the gear tip of the internal gear 552*a*.

When a gap between a tubular portion 551*a* and the retaining member 552*c* of the comparative intermediate member 552 in the radial direction of the comparative intermediate member 552 is small, the comparative intermediate member 552 cannot be tilted fully, resulting in narrowing a range that can allow axis misalignment and angular misalignment. In the comparative intermediate member 552, in a case in which the outer diameter of the comparative intermediate member 552 is made to be not more than twice the diameter of the drive output shaft 61 (6 mm), the gap between the tubular portion 551*a* and the retaining member 552*c* of the comparative intermediate member 552 in the radial direction of the comparative intermediate member 552 becomes small. Therefore, the comparative intermediate member 552 cannot be tilted fully, and as a result, the range that can allow axis misalignment and angular misalignment is reduced.

In addition, if there is axis misalignment between the shaft 143*b* of the developer supply screw 43*b* and the drive output shaft 61, when the intermediate member 52 is drivingly coupled with the screw input joint 53 from the state illustrated in FIG. 13B, the intermediate member 52 in a tilted state slides toward the near side of the image forming apparatus 100 by the biasing force of the spring 66. At this time, in the comparative intermediate member 552, it is likely that the retaining member 552*c* contacts the end portion of the tubular portion 551*a* on the far side of the image forming apparatus 100, as illustrated in FIG. 16. As a result, the comparative intermediate member 552 cannot move to the drive coupling position, and therefore part of the retaining member 552*c* remains held between the slide member 67 and the end portion of the tubular portion 551*a* on the far side of the image forming apparatus 100. Accordingly, the comparative intermediate member 552 is fixed at a constant angle, and therefore the axis misalignment cannot be absorbed fully. Accordingly, occurrence of a reaction force cannot be restrained completely.

By contrast, in the present embodiment, the inner diameter D of the retaining portion 52*c* has the same length as the tooth tip circle diameter of the internal gear 52*a*. According to this configuration, even when the outer diameter of the intermediate member 52 is not more than twice the diameter of the drive output shaft 61 (6 mm), the gap between the retaining portion 52*c* and the tubular portion 51*a* can be ensured sufficiently. Further, even if the intermediate member 52 in a tilted state slides toward the near side of the image forming apparatus 100 by the biasing force of the spring 66, the retaining portion 52*c* is prevented from contacting the end portion of the tubular portion 51*a* on the far side of the image forming apparatus 100, and therefore can be slid to move to the drive coupling position. Accordingly, the intermediate member 52 can be inclined smoothly, axis misalignment and angular misalignment can be absorbed preferably, and the reaction force can be reduced. Further, an angle of inclination of the intermediate member 52 can be increased and the range that allows axis misalignment and angular misalignment can also be increased.

As long as the retaining portion 52*c* is located facing the external teeth of the output external gear 51*c*, the retaining portion 52*c* contacts the external teeth of the output external gear 51*c*, and therefore the intermediate member 52 can be prevented from coming off. Therefore, the inner diameter D of the retaining portion 52*c* may be greater than or equal to the tooth tip circle diameter of the internal gear 52*a* and may be smaller than or equal to the tooth tip circle diameter of the output external gear 51*c*. Accordingly, while ensuring the function of coming off prevention of the intermediate member 52, the gap between the retaining portion 52*c* and the tubular portion 51*a* can be left sufficiently. However, due to easy molding and from a view point of enhancement of rigidity of the internal teeth in the rotational direction of the internal gear 52*a* of the intermediate member 52, the inner diameter D of the retaining portion 52*c* has the same length as the tooth tip circle diameter of the internal gear 52*a*.

Further, in the present embodiment, as illustrated in FIG. 8, the diameter of the joint attaching portion 61*a* of the drive output shaft 61 on which the screw output joint 51 is mounted is smaller than the diameter of the drive output shaft 61. Accordingly, the outer diameter of the screw output joint 51 can be decreased. As a result, even when the outer diameter of the intermediate member 52 is not more than twice the diameter of the drive output shaft 61, the gap between the retaining portion 52*c* and the tubular portion 51*a* can be ensured. Accordingly, the angle of inclination of the intermediate member 52 can be increased and the range that allows axis misalignment and angular misalignment can also be increased. Further, the retaining portion 52*c* is disposed not to contact the tubular portion 51*a*.

Next, a description is given of a configuration of a screw joint 50A, which is a variation of the screw joint 50.

Variation 1.

Figure 17:
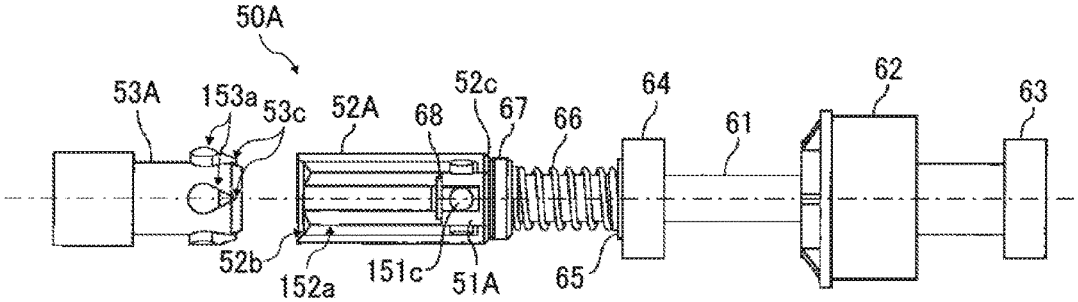
FIG. 17 is a schematic diagram illustrating a screw joint according to Variation 1.
Figure 18A:
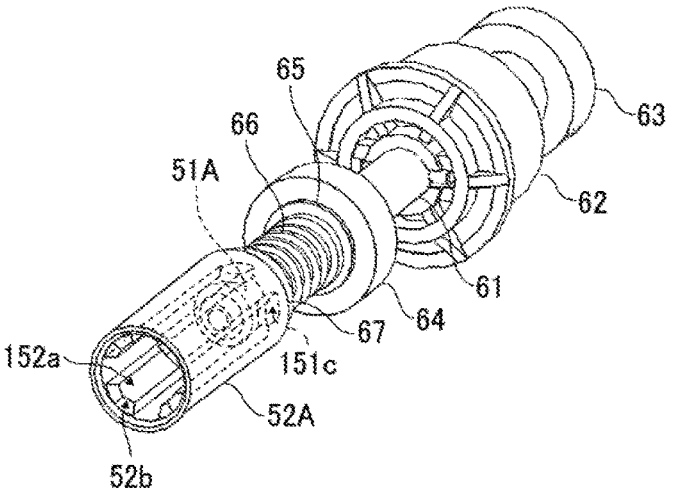
FIG. 18A is a perspective view illustrating the screw joint of Variation 1 on the side of the apparatus body of the image forming apparatus.
Figure 18B:
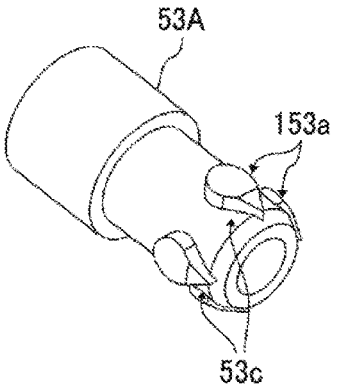
FIG. 18B is a perspective view illustrating the screw joint of Variation 1 on the side of the process cartridge.

FIG. 17 is a schematic diagram illustrating the screw joint 50A according to Variation 1. FIG. 18A is a perspective view illustrating the screw joint 50A of Variation 1 on the side of the apparatus body of the image forming apparatus 100. FIG. 18B is a perspective view illustrating the screw joint 50A of Variation 1 on the side of the process cartridge 40.

It is to be noted that an intermediate member 52A is illustrated in cross section so that the configuration of a screw output joint 51A can be seen clearly.

In Variation 1, each of multiple output projections 151*c* having a cylindrical shape and projecting form the outer circumferential surface of the screw output joint 51A functions as a drive transmitting portion that transmits a driving force to the intermediate member 52A of the screw output joint 51A. In Variation 1, the multiple output projections 151*c* include four output projection 151*c* and are mounted on the outer circumferential surface of the screw output joint 51A spaced from each other at intervals of 90 degrees.

Multiple relay projections 152*a* are mounted on the inner circumferential surface of the intermediate member 52A. Each of the multiple relay projections 152*a* contacts each corresponding one of the multiple output projections 151*c* from the rotational direction of the intermediate member 52A. The multiple relay projections 152*a* receive the driving force from the multiple output projections 151*c* and, at the same time, transmit the driving force to the screw input joint 53A. In Variation 1, the multiple relay projections 152*a* include four relay projections 152*a* and are mounted on the inner circumferential surface of the intermediate member 52A, spaced from each other at intervals of 90 degrees in the rotational direction of the intermediate member 52A and extending in the axial direction of the intermediate member 52A. Each of the output projections 151*c* is engaged with a groove formed between adjacent two of the multiple relay projections 152*a*. The tapered portion 52*b* is formed at the end portion of each of the relay projections 152*a* on the near side of the image forming apparatus 100. The tapered portion 52*b* becomes greater in height and in length in the rotational direction of the screw joint 50A, from the near side toward the far side of the image forming apparatus 100.

Multiple input projections 153*a* are mounted on the outer circumference of the screw input joint 53A. Each of the multiple input projections 153*a* contacts each corresponding one of the multiple relay projections 152*a* from the rotational direction of the screw input joint 53A. The multiple input projections 153*a* have a cylindrical shape and receive the driving force from the multiple relay projections 152*a*. The input projections 153*a* include four input projections 153*a* and are disposed to be spaced from each other at intervals of 90 degrees in the screw input joint 53A and extending in the axial direction of the screw input joint 53A. The tapered portion 53*c* is formed at the leading end of each of the input projections 153*a* on the far side of the image forming apparatus 100. The tapered portion 53*c* becomes greater in height and in length in the rotational direction of the screw joint 50A, from the far side toward the near side of the image forming apparatus 100.

The inner diameter of each of the relay projections 152*a* is greater than the outer diameter of the screw output joint 51A and the outer diameter of the screw input joint 53A. According to this configuration, a predetermined gap is formed in the radial direction of the screw joint 50A between the relay projections 152*a* and the screw output joint 51A and between the relay projections 152*a* and the screw input joint 53A.

The inner diameter of each of the intermediate member 52 is greater than the outer diameter of the output projections 151*c* and the outer diameter of the input projections 153*a*. According to this configuration, a predetermined gap is formed between the intermediate member 52 and the output projections 151*c* and between the intermediate member 52 and the input projections 153*a*.

Further, respective lengths in the rotational direction of the relay projections 152*a*, the output projections 151*c*, and the relay projections 152*a* are set such that a predetermined gap is formed in the rotational direction of the screw joint 50A between the relay projections 152*a* and the output projections 151*c* and between the relay projections 152*a* and the input projections 153*a*.

Further, the retaining portion 52*c* has the length greater than or equal to the inner diameter of each of the relay projections 152*a* and smaller than or equal to the outer diameter of each of the output projections 151*c*. The retaining portion 52*c* also has a specified gap between the outer diameter of the screw output joint 51A and the retaining portion 52*c*, and faces the output projections 151*c*.

With this configuration, in Variation 1, the intermediate member 52A can be slid in the axial direction thereof and be tilted to the axial direction thereof by a predetermined angle.

Further, in Variation 1, the output projections 151*c* and the input projections 153*a* have a cylindrical shape. By so doing, when the output projections 151*c* and the input projections 153*a* rotate, the surface of each of the output projections 151*c* and the surface of each of the input projections 153*a* contact the relay projections 152*a* contact circularly curved surfaces along the axial direction of the screw joint 50A. Accordingly, the intermediate member 52 can be inclined smoothly, and axis misalignment and angular misalignment can be absorbed preferably.

Further, it is also preferable in Variation 1 to set Young's modulus of the screw output joint 51A and Young's modulus of the screw input joint 53A to be greater than Young's modulus of the intermediate member 52A. Accordingly, wear on the surface of each of the output projections 151*c* and on the surface of each of the input projections 153*a* contacting the relay projections 152*a* can be prevented, and therefore the circularly curved surfaces can be maintained.

Variation 2.

Next, a description is given of a configuration of a screw joint 50B, which is another variation of the screw joint 50.

Figure 19:
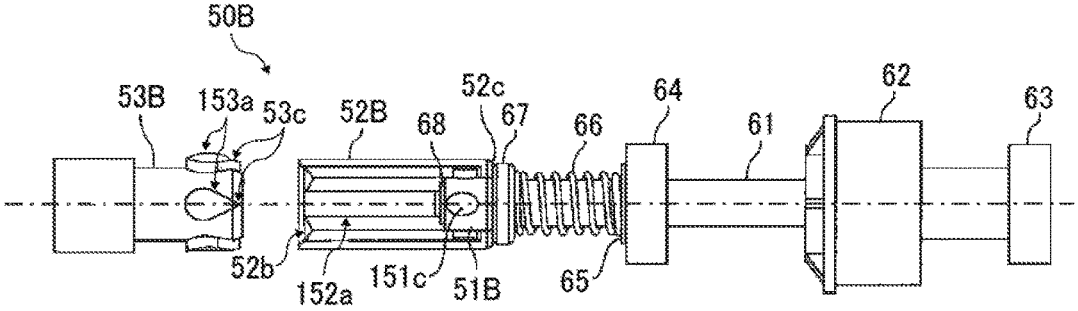
FIG. 19 is a schematic diagram illustrating a screw joint according to Variation 2.
Figure 20A:
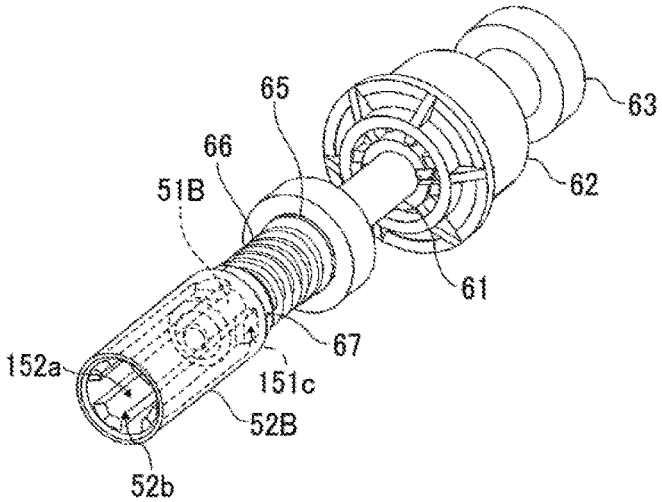
FIG. 20A is a perspective view illustrating the screw joint of Variation 3 on the side of the apparatus body.
Figure 20B:
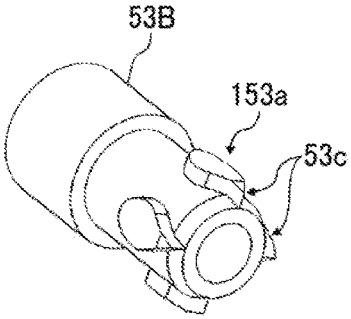
FIG. 20B is a perspective view illustrating the screw joint of Variation 3 on the side of the process cartridge.

FIG. 19 is a schematic diagram illustrating the screw joint 50B according to Variation 2. FIG. 20A is a perspective view illustrating the screw joint 50B of Variation 2 on the side of the apparatus body of the image forming apparatus 100. FIG. 20B is a perspective view illustrating the screw joint 50B of Variation 2 on the side of the process cartridge 40.

It is to be noted that an intermediate member 52B is illustrated in cross section so that the configuration of a screw output joint 51B can be seen clearly.

In Variation 2, each of multiple output projections 151*c* mounted on the screw output joint 51B has an elliptical cross section and each of multiple input projections 153*a* mounted on a screw input joint 53B has a teardrop shape in cross section. The length in the axial direction of the screw joint 50B is greater than the length in a rotational direction of the screw joint 50B. By providing the length in the axial direction of the screw joint 50B greater than the length in the rotational direction of the screw joint 50B, the strength of the output projections 151*c* and the input projections 153*a* can be increased, when compared with the strength of the output projections 151*c* and the input projections 153*a* in Variation 1 where the output projections 151*c* and the input projections 153*a* have a cylindrical shape with a circular shape in cross section and the length in the rotational direction of the screw joint 50B is same as the length in the axial direction of the screw joint 50B.

Further, in Variation 2, the output projections 151*c* have the elliptical cross section and the input projections 153*a* have the teardrop shape in cross section. Therefore, the surface perpendicular to the rotational direction of the screw joint 50B is a curved surface that curves in an arc shape along the axial direction of the screw joint 50B. Accordingly, when the output projections 151*c* and the input projections 153*a* are rotated, the surface of each of the output projections 151*c* and the surface of each of the input projections 153*a* can contact the relay projections 152*a* at the circularly curved surfaces along the axial direction of the screw joint 50B. Therefore, the intermediate member 52B can be inclined smoothly, and axis misalignment and angular misalignment can be absorbed preferably.

Variation 3.

Next, a description is given of a configuration of a screw joint 50C, which is yet another variation of the screw joint 50.

Figure 21:
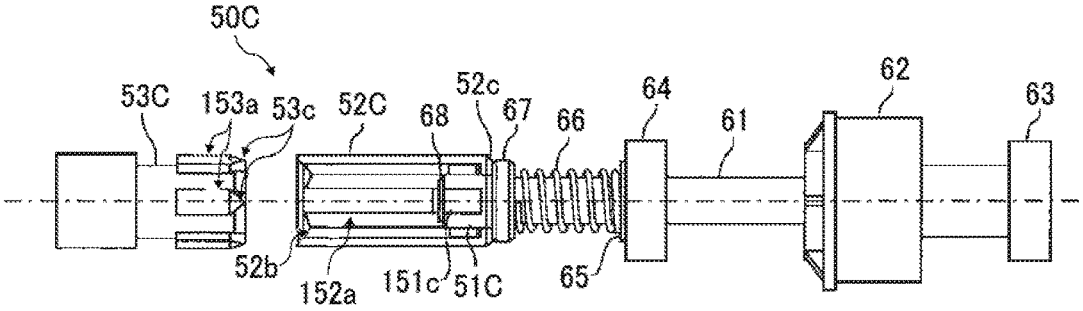
FIG. 21 is a schematic diagram illustrating a screw joint according to Variation 3.
Figure 22A:
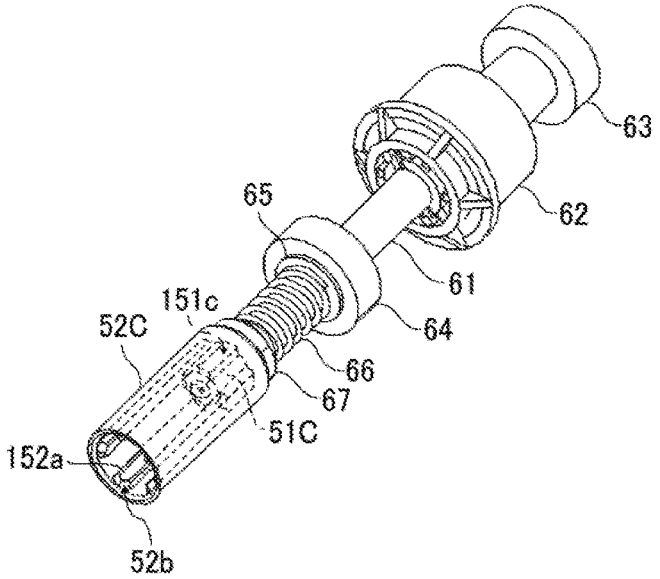
FIG. 22A is a perspective view illustrating the screw joint of Variation 3 on the side of the apparatus body.
Figure 22B:
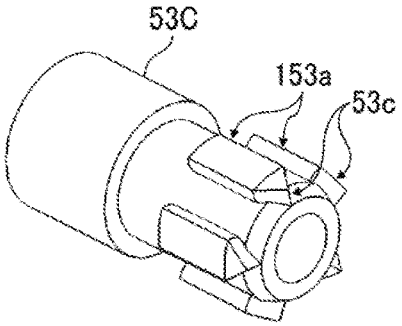
FIG. 22B is a perspective view illustrating the screw joint of Variation 3 on the side of the process cartridge.

FIG. 21 is a schematic diagram illustrating the screw joint 50 according to Variation 3. FIG. 22A is a perspective view illustrating the screw joint 50C of Variation 3 on the side of the apparatus body of the image forming apparatus 100. FIG. 22B is a perspective view illustrating the screw joint 50C of Variation 3 on the side of the process cartridge 40.

It is to be noted that an intermediate member 52C is illustrated in cross section so that the configuration of the screw output joint 51C can be seen clearly.

In Variation 3, each of multiple output projections 151*c* and each of the input projections 153*a* have a rectangular shape in cross section. By providing this configuration, the length in an axial direction of the screw input joint 50C can be greater than the length in a rotational direction of the screw joint 50C, and therefore the strength of the output projections 151*c* and the input projections 153*a* can be increased.

Figure 23:
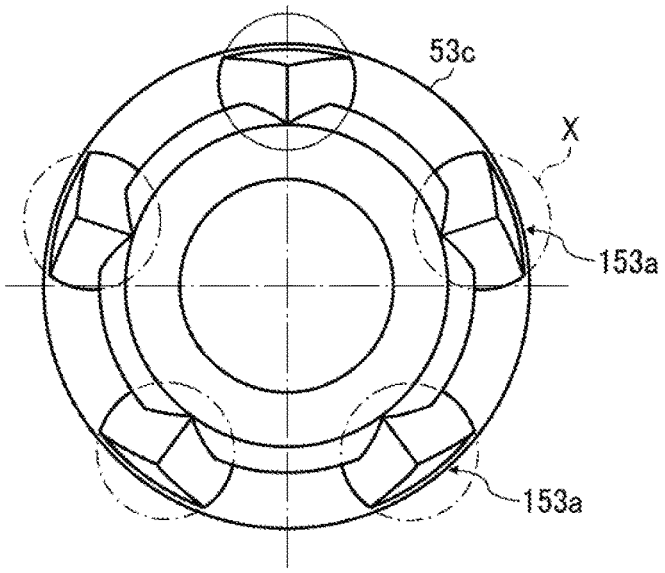
FIG. 23 is a diagram illustrating the screw input joint of Variation 3, viewed from the far side.

FIG. 23 is a diagram illustrating a screw input joint 53C of Variation 3, viewed from the far side of the image firming apparatus 100.

As illustrated in FIG. 23, in Variation 3, a plane that is parallel to the axial direction of the input projections 153*a* is an arc of a circle X illustrated in a dot-dashed line in FIG. 23 which is a circularly curved surface along the radial direction of the screw joint 50C.

In addition, a plane that is parallel to the axial direction of the output projection 151*c* is also the circularly curved surface along the radial direction of the screw joint 50C.

With this configuration, the contact of the intermediate member 52C with the relay projections 152*a* during rotation can be a line contact, and therefore the intermediate member 52C can be inclined smoothly. Further, in the above description, a plane that is parallel to the axial direction of the screw joint 50C to both an upstream side and a downstream side in the rotational direction of the screw joint 50C is a circularly curved surface along the radial direction of the screw joint 50C. However, of the two planes, a single plane of the intermediate member 52C contacting the relay projections 152*a* of the two planes may be a circularly curved surface along the radial direction of the screw joint 50C.

Further, in Variation 3, a surface perpendicular to the rotational direction of the input projections 153*a* and the output projections 151*c* is not an arc shape along the axial direction of the screw joint 50C but a linear shape. Therefore, the following advantages can be ensured. That is, the screw output joint 51C and the screw input joint 53C are made of resin and are molded by using molds. For example, the screw output joint 51C having a substantially cylindrical shape can be molded using two molds moving in different mold opening directions at different axial directions when opening the molds.

Similar to Variation 1 and Variation 2, in a case in which a surface of the output projections 151*c* that is perpendicular to the rotational direction of the screw output joint 51C is a curved surface that curves in an arc shape along the axial direction of the screw joint 50C the axial center of the output projections 151*c*, which is thickest in the rotation direction, is set to be a parting line. If the axial center of the output projections 151*c* is not set to be a parting line, the mold cannot be moved in the axial direction of the screw joint 50C, and therefore the mold cannot be opened. As a result, it is likely that there may be burr on the surface of the output projections 151*c* that contacts the relay projections 152*a* of the intermediate member 52. Accordingly, a smooth inclination of the intermediate member 52 is likely to be hindered.

Further, when rotating the intermediate member 52 in a tilted state, the output projections 151*c* move relative to the relay projections 152*a*. However, if there is burr, the progress of wear is accelerated, and therefore the intermediate member 52 is likely to be worn earlier than usual.

Further, in the screw input joint 53 in which the outer diameter of the attaching portion 53*b* is greater than the outer diameter of a portion where the input projections 153*a* are formed, in a case in which the surface of the input projections 153*a* that is perpendicular to the rotational direction of the screw joint 50C is a circularly curved surface along the axial direction of the screw joint 50C, at least four molds are prepared. Specifically, the at least four molds include a pair of molds that moves in a normal direction and a pair of molds that moves in the axial direction of the screw joint 50C. As a result, the cost for molds increases, which leads to an increase in manufacturing cost of an entire image forming apparatus.

By contrast, in Variation 3, the surface of the output projections 151*c* that is perpendicular to the rotational direction of the screw joint 50C has a linear portion along the axial direction of the screw joint 50C. Therefore, the surface of the intermediate member 52 that contacts the relay projections 152*a* when the output projections 151*c* rotate can be molded using a single mold, and burr on this surface can be prevented. Accordingly, the intermediate member 52 can be inclined smoothly, and acceleration of progress of wear can also be prevented at an early stage.

Further, by forming the surface of the input projections 153*a* that is perpendicular to the rotational direction of the screw joint 50C in a straight line along the axial direction of the screw joint 50C, the screw input joint 53 can be molded using a pan of molds moving in the axial direction of the screw joint 50C. Accordingly, the number of molds can be reduced, and therefore a reduction in manufacturing cost can be achieved.

Variation 4.

Next, a description is given of a configuration of a screw joint 50D, which is yet another variation of the screw joint 50.

Figure 24:
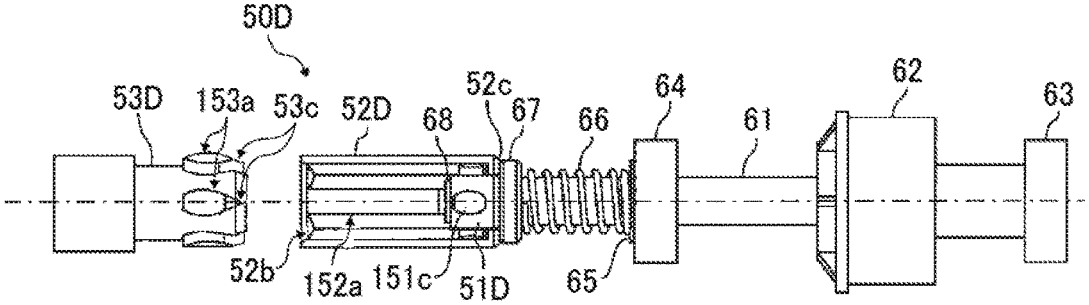
FIG. 24 is a schematic diagram illustrating a screw joint according to Variation 4.
Figure 25A:
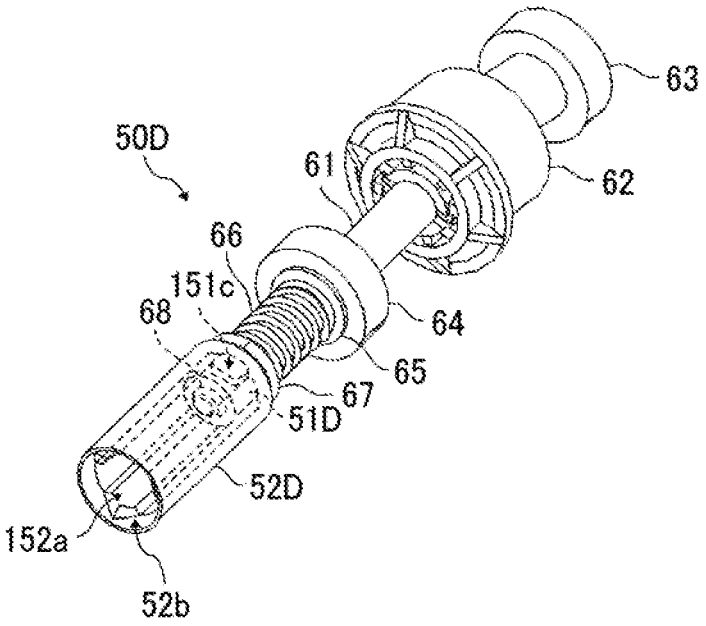
FIG. 25A is a perspective view illustrating the screw joint of Variation 4 on the side of the apparatus body.
Figure 25B:
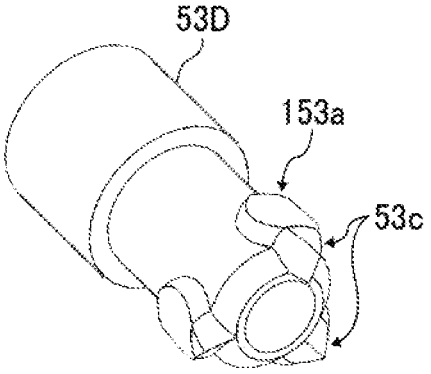
FIG. 25B is a perspective view illustrating the screw joint of Variation 4 on the side of the process cartridge.

FIG. 24 is a schematic diagram illustrating the screw joint 50D according to Variation 4. FIG. 25A is a perspective view illustrating the screw joint 50D of Variation 4 on the side of the apparatus body of the image forming apparatus 100. FIG. 25B is a perspective view illustrating the screw joint 50D of Variation 4 on the side of the process cartridge 40.

It is to be noted that an intermediate member 52D is illustrated in cross section so that the configuration of a screw output joint 51D can be seen clearly.

Figure 26B:
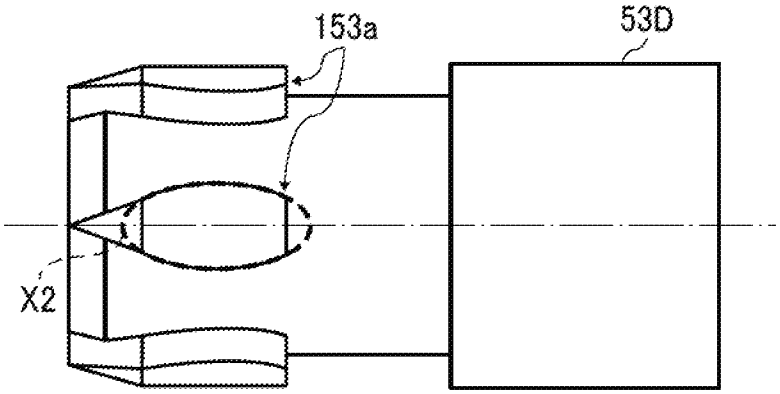
FIG. 26B is a side view illustrating the screw joint of Variation 4.
Figure 26A:
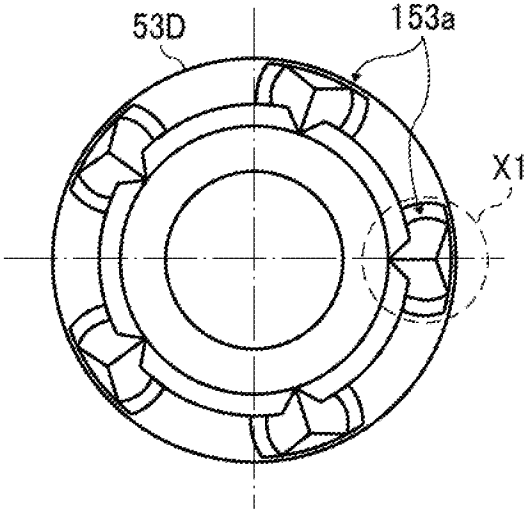
FIG. 26A is a front view illustrating the screw joint of Variation 4, viewed from the far side.

FIG. 26A is a front view illustrating the screw joint 50D of Variation 4, viewed from the far side of the image firming apparatus 100. FIG. 26B is a side view illustrating the screw joint 50D of Variation 4.

In Variation 4, a surface perpendicular to the rotational direction of the input projections 153*a* and the output projections 151*c* is a curved surface of an ellipsoid. To be more specific, as illustrated in FIG. 26A, a surface parallel to the axial direction of the screw joint 50D is a circularly curved surface along the radial direction of the screw joint 50D (a circular arc surface of a circle X1 illustrated with a broken line in FIG. 26A) and, at the same time, as illustrated in FIG. 26B, is a circularly curved surface along the axial direction (a circular arc surface of an ellipse X2 illustrated with a broken line in FIG. 26B).

With this configuration, the contact of the intermediate member 52D with the relay projections 152*a* can be a point contact, and therefore the intermediate member 52C can be inclined more smoothly when compared with the configurations of Variations 1, 2 and 3. Further, in Variation 4, the surface alone to contact the relay projections 152*a* during rotation may be a curved surface of an ellipsoid.

Figure 27:
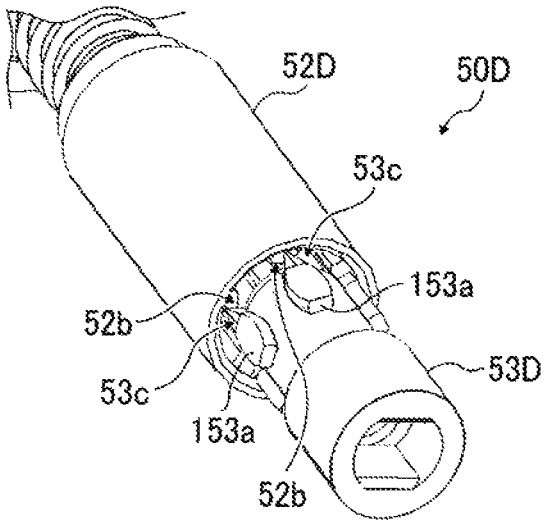
FIG. 27 is a diagram illustrating a configuration iii which multiple input projections on the far side of the image forming apparatus are disposed with the respective leading ends arranged at the same positions in an axial direction of the screw input joint.

FIG. 27 is a diagram illustrating a configuration in which the input projections 153*a* on the far side of the image forming apparatus 100 are disposed with the respective leading ends arranged at the same positions in the axial direction of a screw input joint 53D.

As an amount of axis misalignment between the drive output shaft 61 and the developer supply screw 43*b* increases, there is a case, as illustrated in FIG. 27, that adjacent two input projections 153*a* of the multiple input projections 153*a* tend to enter the same groove (e.g. a gap between adjacent two of the relay projections 152*a*) guided by the tapered portions 52*b* of the relay projections 152*a* different from each other. In this case, when the intermediate member 52D rotates, the intermediate member 52D moves toward the far side of the image forming apparatus 100 in the axial direction of the of the screw joint 50D against the biasing force of the spring 66, and therefore one of the adjacent two input projections 153*a* climbs over the tapered portion 52*b* and relatively moves to the appropriate groove. Accordingly, the intermediate member 52D and the screw input joint 53D are eventually drivingly coupled with each other. However, a great amount of load is applied to the one of the adjacent two input projections 153*a* when climbing over the tapered portion 52*b*, and therefore it is likely that the one adjacent two input projections 153*a* is damaged or broken.

Figure 28:
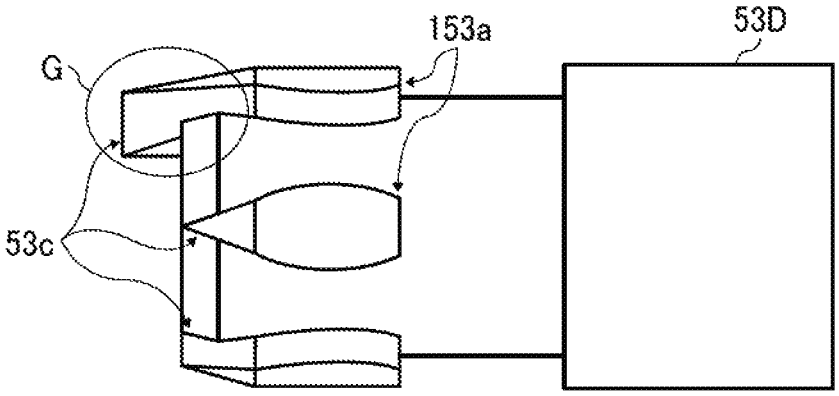
FIG. 28 is a diagram illustrating the screw joint of Variation 4, with one of the multiple input projections formed longer than the rest of the multiple input projections.

Now, FIG. 28 is a diagram illustrating the screw joint 50D of Variation 4, with one of the multiple input projections 153*a* formed longer than the rest of the multiple input projections 153*a*. Hereinafter, the one of the multiple input projections 153*a* formed longer than the rest of the multiple input projections 153*a* is referred to as a "long input projection 153*a*".

In order to address this inconvenience, as illustrated in FIG. 28, it is preferable that one of the multiple input projections 153*a* (i.e., the long input projection 153*a*) is formed longer (toward the far side of the image forming apparatus 100) than the rest of the multiple input projections 153*a*. By so doing, the tapered portion 53*c* of the long input projection 153*a* that is projected toward the far side of the image forming apparatus 100 farther than the rest of the multiple input projections 153*a* contacts the tapered portion 52*b* of the relay projection 152*a* of the intermediate member 52D. Accordingly, the tapered portion 53*c* of the long input projection 153*a* presses the intermediate member 52D toward the far side of the image forming apparatus 100 in the axial direction of the screw joint 50D. As the intermediate member 52D is pressed toward the far side of the image forming apparatus 100 in the axial direction of the screw joint 50, the spring 66 is compressed and the biasing force of the spring 66 increases.

When the intermediate member 52D is inserted by a certain amount, the developer supply screw 43*b* is rotated by the biasing force of the spring 66, and the long input projection 153*a* is guided between the adjacent two relay projections 152*a*. According to this configuration, even when there is a large amount of axis misalignment between the drive output shaft 61 and the developer supply screw 43*b*, and adjacent two input projections 153*a* of the multiple input projections 153*a* tend to enter the same groove a gap between adjacent two of the relay projections 152*a*) guided by the tapered portions 52*b* of the relay projections 152*a* different from each other, the state is canceled or eliminated. Accordingly, it is not likely that any input projection 153*a* climbs over the tapered portion 52*b* to move to the appropriate groove during rotation of the intermediate member 52D. Accordingly, the input projection 153*a* can be prevented from receiving a great amount of load applied when climbing over the tapered portion 52*b*, and therefore can be prevented from being damaged or broken.

In the above configuration of Variation 4, one of the input projections 153*a* is projected to the far side of the image forming apparatus 100 but the configuration is not limited thereto. For example, a configuration in which one of the tapered portions 52*b* of the intermediate member 52D is projected toward the near side of the image forming apparatus 100 farther than the rest of the tapered portions 52*b* may be applied to this disclosure.

Further, as illustrated in FIG. 28, it is preferable that the length, in the radial direction of the screw joint 50D, of an extended portion of the long input projection 153*a* extending longer than the rest of the input projections 153*a* becomes narrower toward the far side of the image forming apparatus 100 (i.e., the tip of the extended portion).

Figure 29:
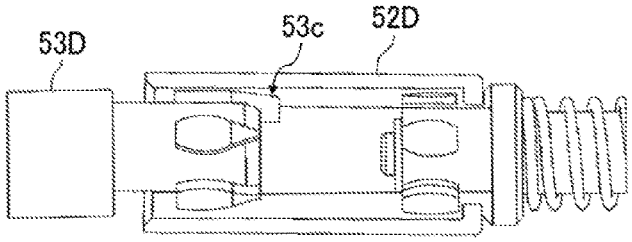
FIG. 29 is a diagram illustrating the screw joint in a state in which the drive output shaft is in axis misalignment in a direction separating from the one of the multiple input projections more projecting than the rest of the multiple input projections.

FIG. 29 is a diagram illustrating the screw joint 50D in a state in which the drive output shaft 61 is in axis misalignment in a separating direction from the extended portion of the long input projection 153*a* from the rest of the input projections 153*a*.

As illustrated in FIG. 29, when axis misalignment in which the drive output shaft 61 moves from the extended portion of the long input projection 153*a* in the separating direction, the intermediate member 52D tilts in a counterclockwise direction in FIG. 29. As the intermediate member 52D is tilted as illustrated in FIG. 29, the inner circumferential surface of the intermediate member 52D on the far side of the image forming apparatus 100 approaches the long input projection 153*a*.

When the length, in the radial direction of the screw joint 50D, of the extended portion of the long input projection 153*a* from the rest of the input projections 153*a* becomes narrower toward the far side of the image forming apparatus 100 (i.e., the tip of the extended portion), a gap between the long input projection 153*a* and the inner circumferential surface of the intermediate member 52D increases toward the far side of the image forming apparatus 100. As a result, when the intermediate member 52D is tilted as illustrated in FIG. 29, the extended portion of the long input projection 153*a* can be prevented from contacting the inner circumferential surface of the intermediate member 52D. Accordingly, prevention of inclination of the intermediate member 52 can be restrained, and an allowable amount of axis misalignment (an amount of axis misalignment that can be restrain occurrence of the axial reaction force) can be increased.

Variation 5.

Next, a description is given of a configuration of a screw joint 50E, which is yet another variation of the screw joint 50.

Figure 30:
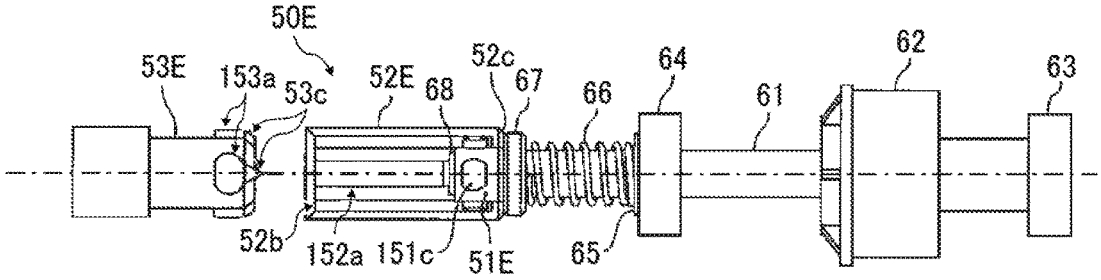
FIG. 30 is a schematic diagram illustrating a screw joint according to Variation 5.
Figure 31A:
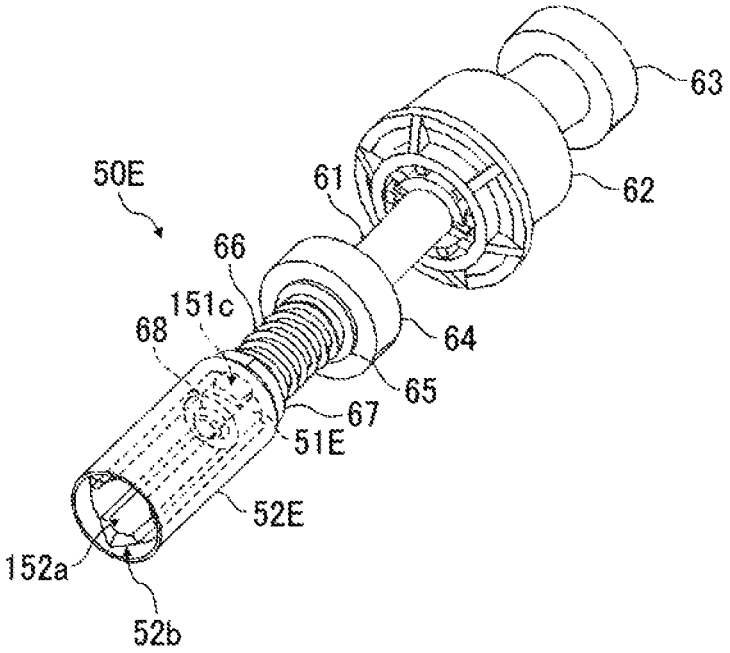
FIG. 31A is a perspective view illustrating the screw joint of Variation 5 on the side of the apparatus body.
Figure 31B:
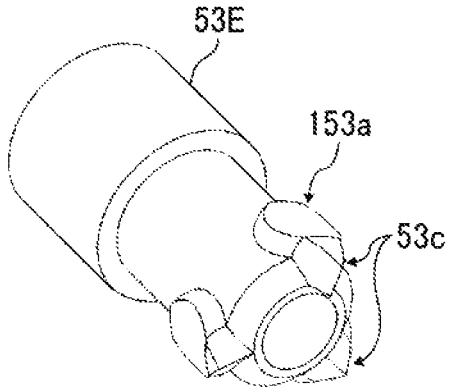
FIG. 31B is a perspective view illustrating the screw joint of Variation 5 on the side of the process cartridge.
Figure 32B:
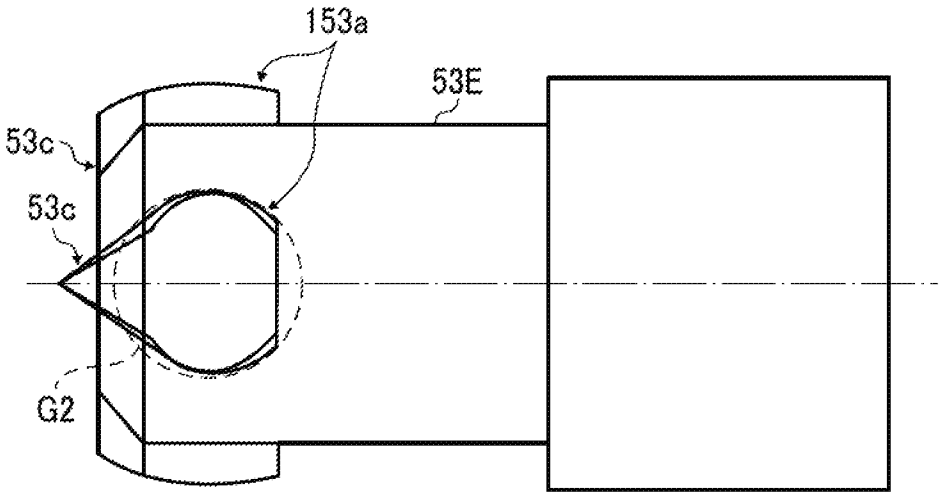
FIG. 32B is a side view illustrating the screw joint of Variation 5.
Figure 32A:
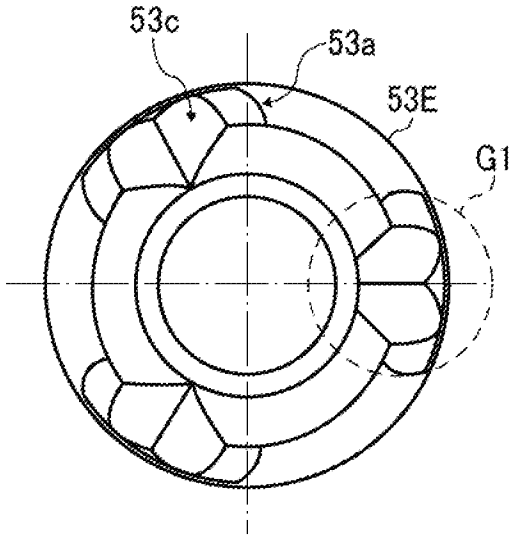
FIG. 32A is a front view illustrating the screw joint of Variation 5, viewed from the far side.

FIG. 30 is a schematic diagram illustrating the screw joint 50E according to Variation 5. FIG. 31A is a perspective view illustrating the screw joint 50E of Variation 5 on the side of the apparatus body of the image forming apparatus 100. FIG. 31B is a perspective view illustrating the screw joint 50E of Variation 5 on the side of the process cartridge 40. FIG. 32A is a front view illustrating the screw joint 50E of Variation 5, viewed from the far side of the image forming apparatus 100. FIG. 32B is a side view illustrating the screw joint 50E of Variation 5.

It is to be noted that an intermediate member 52E is illustrated in cross section so that the configuration of a screw output joint 51E can be seen clearly.

In Variation 5, as illustrated in FIGS. 32A and 32B, a surface perpendicular to the rotational direction of the output projections 151*c* mounted on the screw output joint 51E and the input projections 153*a* mounted on a screw input joint 53E is a spherical surface. To be more specific, as illustrated in FIG. 32A, a side surface of the output projections 151*c* and the input projections 153*a* in the rotational direction of the screw joint 50E is a circularly curved surface along the radial direction of the screw joint 50E (a circular arc surface of a circle G1 illustrated with a broken line in FIG. 32A). At the same tune, as illustrated in FIG. 32B, the side surface of the output projections 151*c* and the input projections 153*a* in the rotational direction of the screw joint 50E is a circularly curved surface along the axial direction of the screw joint 50E (a circular arc surface of a circle G2 illustrated with a broken line in FIG. 32B). With this configuration, the contact of the intermediate member 52E with the relay projections 152*a* can be a point contact, which is same as Variation 4, and the intermediate member 52E can be inclined more smoothly when compared with the configurations of Variations 1, 2 and 3, in which the contact of the respective intermediate members 52A, 52B and 52C with the relay projections 152*a* is line contact.

In the present embodiment, the side surfaces of the output projections 151*c* and the input projections 153*a* at both sides in the rotational direction of the screw joint 50E is a circularly curved surface. However, one side surface alone to which the relay projections 152*a* during drive transmission may be a circularly curved surface. To be more specific, the side surface at the downstream side of the output projections 151*c* in the rotational direction of the screw joint 50E 151*c* is a spherical surface and the side surface at the upstream side of the input projections 153*a* in the rotational direction of the screw joint 50E is a spherical surface.

Further, in Variation 5, the output projections 151*c* have not a circle but a rectangle shape with rounded corners when viewed from the normal direction. Accordingly the length in the axial direction of the output projections 151*c* in this configuration can be shorter than the length in the axial direction of the output projections 151*c* having a circular shape when viewed from the normal direction, and therefore the size of the screw joint 50E can be reduced in the axial direction of the screw joint 50E. Similarly, the input projections 153*a* have not a circle but a rectangle shape with rounded corners when viewed from the normal direction. Accordingly, the length in the axial direction of the input projections 153*a* in this configuration can be shorter than the length in the axial direction of the input projections 153*a* having a circular shape when viewed from the normal direction, and therefore the size of the screw joint 50E can be further reduced in the axial direction of the screw joint 50E.

Similar to the configuration of Variation 4, it is preferable that one of the multiple input projections 153*a* is formed longer (toward the far side of the image forming apparatus 100) than the rest of the multiple input projections 153*a*. By so doing, similar to Variation 4, it is not likely that any input projection 153*a* climbs over the tapered portion 52*b* during rotation of the intermediate member 52D so as to drivingly couple the intermediate member 52D and the screw input joint 53D with each other. Accordingly, the input projection 153*a* can be prevented from receiving a great amount of load applied when climbing over the tapered portion 52*b*, and therefore can be prevented front being damaged or broken.

Variation 6.

Next, a description is given of a configuration of a screw joint 50F, which is yet another variation of the screw joint 50.

Figure 33:
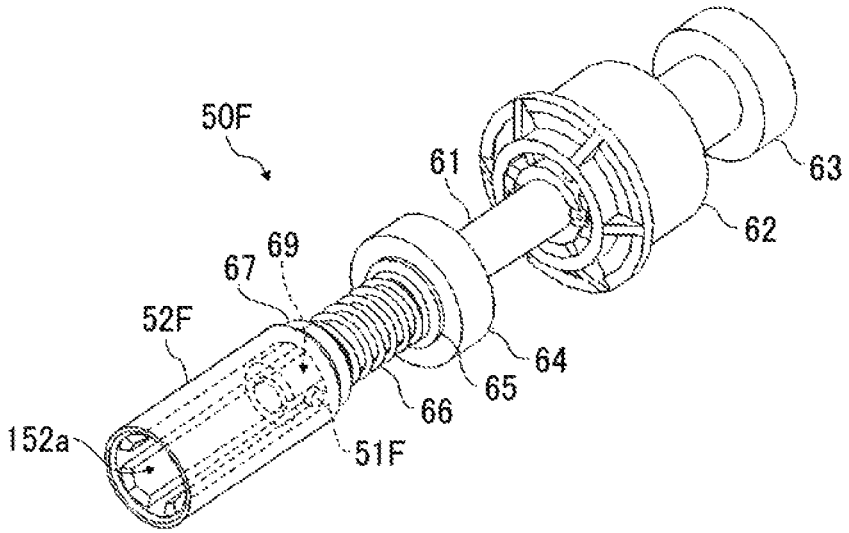
FIG. 33 is a perspective view illustrating a configuration of a screw joint according to Variation 6 disposed on the side of the apparatus body.
Figure 34:
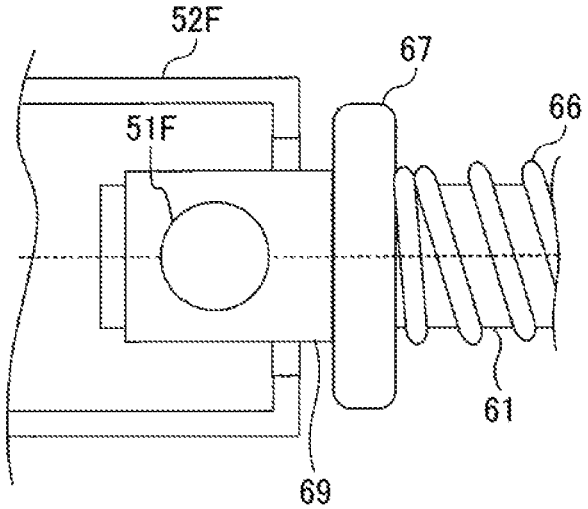
FIG. 34 is a schematic diagram illustrating features of the screw joint of Variation 6.

FIG. 33 is a perspective view illustrating the screw joint 50F of Variation 6 on the side of the apparatus body of the image forming apparatus 100. FIG. 34 is a schematic diagram illustrating features of the screw joint of Variation 6.

In Variation 6, a parallel pin 51F functions as a screw output joint.

In Variation 6, as illustrated in FIG. 34, a regulating member 69 that regulates movement of the slide member 67 toward the near side of the image forming apparatus 100 is mounted on the end portion of the drive output shaft 61 on the near side of the image forming apparatus 100.

A through hole through which the parallel pin 51F goes is formed in the regulating member 69 and another through hole through which the parallel pin 51F also goes is formed on the end portion of the drive output shaft 61 on the near side of the image forming apparatus 100. By causing the parallel pin 51F to go through the through holes, the parallel pin 51F is mounted on the drive output shaft 61 and, at the same time, the regulating member 69 is also mounted on the drive output shaft 61.

As described above, by causing the regulating member 69 to regulate movement of the slide member 67, when an intermediate member 52F is located at the drive coupling position, the slide member 67 and the intermediate member 52F do not contact with each other, and therefore the biasing force of the spring 66 does not affect the intermediate member 52F. Further, as illustrated in FIG. 33, the parallel pin 51F is inserted in a gap between the relay projections 152*a* of the intermediate member 52F (i.e., a gap of the intermediate member 52F). According to this configuration, the rotation driving force is transmitted to the intermediate member 52F via the parallel pin 51F.

It is to be noted that a screw input joint in Variation 6 may be any of the screw input joints 53A through 53E according to Variations 1 through 6.

The parallel pin 51F is made of metal, and therefore can increase the strength of the screw output joint (i.e., the parallel pin 51F in Variation 6) when compared with the configurations of Variations 1 through 5 in which the screw output joints 51A through 51E are made of resin.

Figure 35:
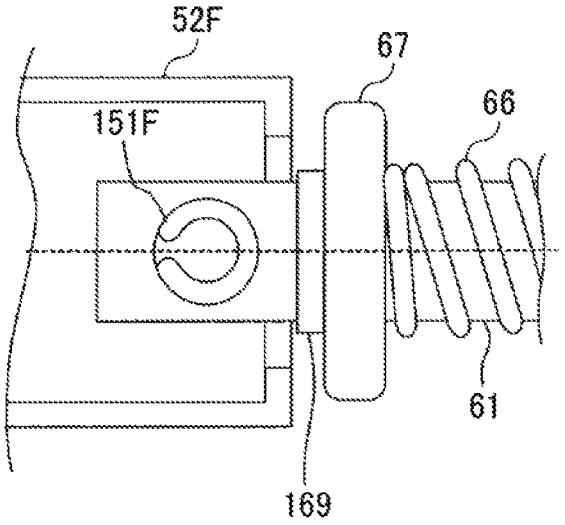
FIG. 35 is a diagram illustrating a spring pin functioning as a screw output joint of Variation 6.

FIG. 35 is a diagram illustrating a spring pin 151E functioning as a screw output joint of Variation 6.

By providing the spring pin 151F to function as a screw output joint of Variation 6, the strength of the screw output joint decreases when compared with the parallel pin 51F acting as a screw output joint. However, the spring pin 151F is easier to be attached to the drive output shaft 61. Since the spring pin 151F is also made of metal, the strength of the screw output joint of Variation 6 can increase when compared with the configurations of Variations 1 through 5 in which the screw output joints 51A through 51E are made of resin.

Further, as illustrated in FIG. 35, it is preferable to attach the spring pin 151F such that the cut end of the spring pin 151E is located to face the near side of the image forming apparatus 100. If the cut end of the spring pin 151F is located to face the far side of the image forming apparatus 100 the retaining portion 52*c* of the intermediate member 52F comes to face the cut end of the spring pin 151F. As a result, the retaining portion 52*c* of the intermediate member 52F is caught by the edge of the cut end of the spring pin 151F, and it is likely that the intermediate member 52F does not incline smoothly. Accordingly, it is likely that the reaction force is generated. By contrast, when the cut end of the spring pin 151F is located to face the near side of the image forming apparatus 100 the retaining portion 52*c* faces the circular arc surface of the spring pin 151F, and therefore the retaining portion 52*c* is not caught by the spring pin 151F. Accordingly, the intermediate member 52F can be inclined smoothly, which can restrain generation of the reaction force.

Further, in the configuration of FIG. 35, an E ring 169 functions as a regulating member to regulate movement of the slide member 67 toward the near side of the image firming apparatus 100.

By inserting the shaft of the developer supply screw to a bearing that is fitted to the developer supply screw included in a developing case, the shaft of the developer supply screw is rotatably supported by the developing case. However, it is difficult to insert a parallel pin or a spring pin into the shaft of the developer supply screw that is supported by the developing case as described above. For this reason, any of the screw input joints 53A through 53E according to Variations 1 through 6 is employed to insert the shaft of the developer supply screw into the screw input joint, so as to assemble the screw input joint to the developer supply screw. Accordingly, the screw input joint is made of resin, which increases the size of the screw input joint larger than the parallel pin to ensure the strength of the input projections. As a result, intervals of the relay projections on the near side of the intermediate member become greater than intervals of the relay projections of the intermediate member through which the parallel pin goes, on the far side of the image forming apparatus. According to this configuration, the length of the relay projections in the rotational direction of the screw joint on the far side of the image forming apparatus becomes greater than the length of the relay projections in the rotational direction of the screw joint on the near side of the image forming apparatus. As a result, a step is formed on the relay projections of the intermediate member in the rotational direction of the screw joint, between the far side and the near side of the image forming apparatus. Such a step can cause the following inconvenience. That is, for assembly of the intermediate member, the intermediate member is fitted from the end portion of the drive output shaft on the far side of the image forming apparatus, is moved to the near side of the image forming apparatus in the axial direction of the screw joint and the parallel pin is inserted into the gap between the relay projections on the far side of the image forming apparatus. At this time, the parallel pin contacts the step, and therefore the intermediate member cannot be assembled smoothly. Further, when the intermediate member is pressed by the screw input joint to move toward the far side of the image forming apparatus, the parallel pin is brought to be located at a position between the relay projections of the intermediate member on the near side of the image forming apparatus. Therefore, the intermediate member rotates, the input projections are located between the relay projections on the near side of the image forming apparatus, the pressing force is released, and the intermediate member moves to the near side of the image forming apparatus by the biasing force of the spring 66. At this time, it is likely that the parallel pin contacts the step. The contact of the parallel pin to the step prevents movement of the intermediate member to the drive coupling position, and therefore the intermediate member cannot be drivingly coupled with the screw input joint normally. Accordingly, it is likely that the reaction force is generated.

Figure 36:
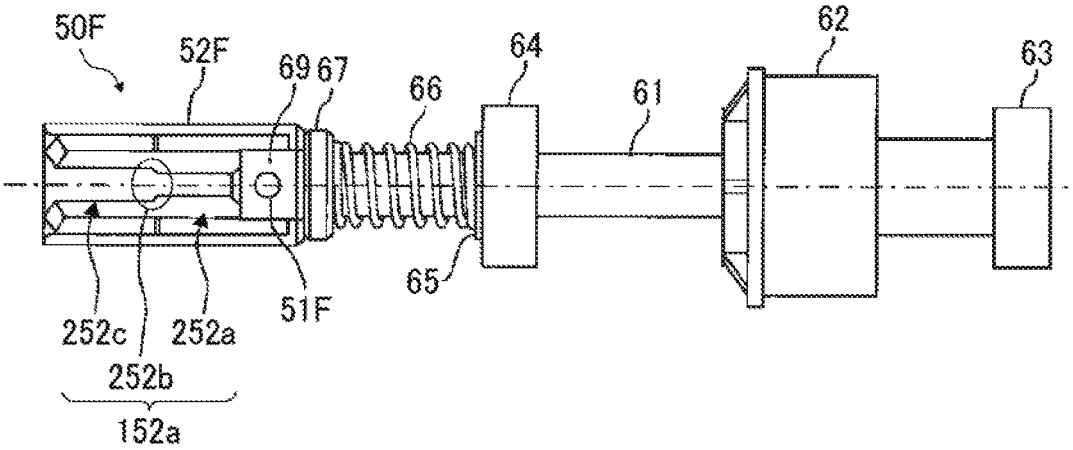
FIG. 36 is a schematic diagram illustrating a relay projection on a far side of the intermediate member into which a parallel pin is inserted and the screw joint of Variation 6 coupled with an intermediate member on a near side of the intermediate member in a tapered shape.

FIG. 36 is a schematic diagram illustrating a configuration on the apparatus body of the image forming apparatus 100 of Variation 6, where far side relay projections 252*a* into which the parallel pin 51F is inserted and near side relay projections 252*c* of the intermediate member 52F are connected by connecting portions 252*b* in a tapered shape.

As indicated by an area surrounded by a circle in FIG. 36 the connecting portions 252*b*, at which the far side relay projections 252*a* and the near side relay projections 252*c* are connected, have a tapered shape that tilts toward the axial direction of the screw joint 50F. With this configuration, the following effects can be achieved. Specifically, as described above, when the parallel pin that is located in a gap between the near side relay projections 252*c* has displacement in phase in the rotational direction of the screw joint 50F to a gap between the far side relay projections 252*a* at assembly of the intermediate member 52F, the parallel pin contacts the connecting portions 252*b*. However, since the connecting portions 252*b* have a tapered shape the parallel pin is guided by the connecting portions 252*b* having a tapered shape to enter into a gap between the far side relay projections 252*a*. Consequently, the intermediate member 52F can be assembled smoothly.

Further, when the intermediate member 52F moves from a drive coupling releasing position to the drive coupling position, even if the parallel pin 51F has displacement in phase in the rotational direction of the screw joint 50F to the gap between the far side relay projections 252*a*, the parallel pin 51F is guided to the connecting portions 252*b* having a tapered shape to be inserted into the gap between the far side relay projections 252*a*. Accordingly, the intermediate member 52F moves to the drive coupling position, and therefore the intermediate member 52F and the screw input joint can be drivingly coupled with each other normally.

Variation 7

Figure 37:
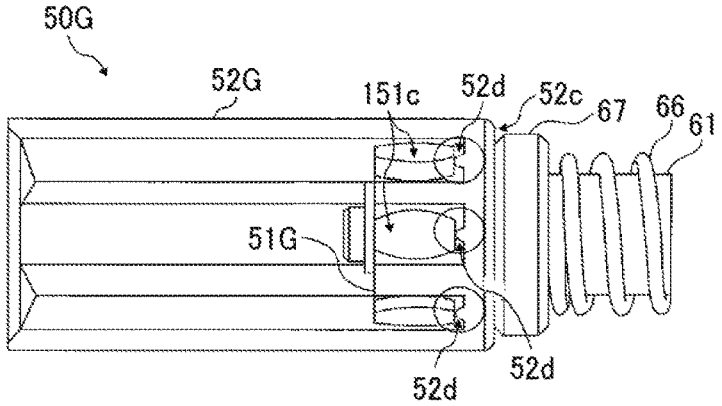
FIG. 37 is an enlarged view illustrating a main part of a screw joint according to Variation 7.

FIG. 37 is an enlarged view illustrating a main part of a screw joint 50G according to Variation 7.

In Variation 7, multiple projections 52*d* are disposed at respective positions facing the output projections 151*c* of the retaining portion 52*c*. The top end of each of the multiple projections 52*d* has a spherical surface. The other parts of the configuration of the screw joint 50G function same as the corresponding parts of the configuration of Variation 4.

Figure 38:
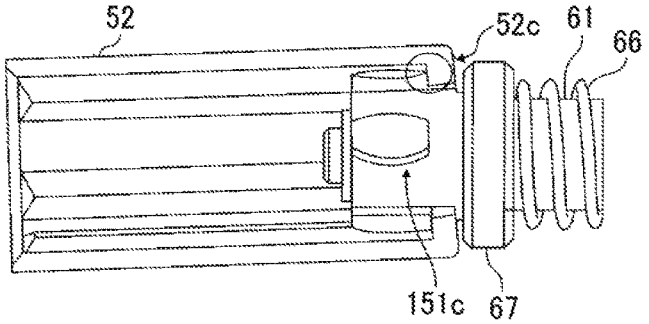
FIG. 38 is a diagram illustrating a case in which a surface of the retaining portion disposed facing the output projections and surfaces of the output projections disposed facing the retaining portion are flat faces.

FIG. 38 is a diagram illustrating a screw joint 50G in a case in which a surface of the retaining portion 52*c* disposed facing the output projections 151*c* of a screw output joint 51G and surfaces of the output projections 151*c* of the screw output joint 51G disposed facing the retaining portion 52*c* are flat faces.

While the cross section of the output projections 151*c* of Variation 4 is a curved surface of an ellipsoid, for example, the cross section of the output projections 151*c* of Variation 7 is a rectangle shape with rounded corners. In a case in which the size of the screw joint 50G with the output projections 151*c* is to be reduced, the surfaces of the output projections 151*c* facing the retaining portion 52*c* are flat faces. When an intermediate member 52G is tilted to the axial direction of the screw joint 50G, the retaining portion 52*c* may contact the output projections 151*c*. As illustrated in FIG. 38, the surface of the retaining portion 52*c* facing the output projections 151*c* and the surface of the output projections 151*c* facing the retaining portion 52*c* are flat, the retaining portion 52*c* contacts the surface of the output projections 151*c* facing the retaining portion 52*c* in line contact. Due to the line contact, the intermediate member 52G can hardly be inclined in a direction perpendicular to the direction of inclination of the intermediate member 52G (i.e., the direction perpendicular to the drawing sheet of FIG. 38). Therefore, it is likely that axis misalignment cannot be absorbed preferably. Consequently, it is likely to cause an increase in reaction force and an increase in rotation non-uniformity.

By contrast, in the configuration of Variation 7 illustrated in FIG. 37, the projections 52*d* are disposed at respective positions of the retaining portion 52*c* facing the output projections 151*c*. Therefore, when the intermediate member 52G tilts in the axial direction of the screw joint 50G, the projections 52*d* of the retaining portion 52*c* contact the surface of the output projections 151*c* facing the retaining portion 52*c*. Accordingly, the projections 52*d* of the retaining portion 52*c* contact the surface of the output projections 151*c* facing the retaining portion 52*c* in substantially point contact, and the intermediate member 52G can be tilted in the direction perpendicular to the direction of inclination of the intermediate member 52G smoothly. Consequently, the axis misalignment can be absorbed preferably, and an increase in reaction force and an increase in rotation non-uniformity can be restrained.

Further, a portion of the retaining portion 52*c* facing the output projections 151*c* may be a spherical surface and be projected toward the output projections 151*c*. According to this configuration, the retaining portion 52*c* of the intermediate member 52G contacts the surface of the output projections 151*c* facing the retaining portion 52*c* in point contact, and the intermediate member 52G can be inclined smoothly in the direction perpendicular to the direction of inclination of the intermediate member 52G. Further, the surface of the output projections 151*c* facing the retaining portion 52*c* may be a spherical surface, and a projection or projections may be mounted on the surface of the output projections 151*c* facing the retaining portion 52*c*.

Variation 8.

Figure 39:
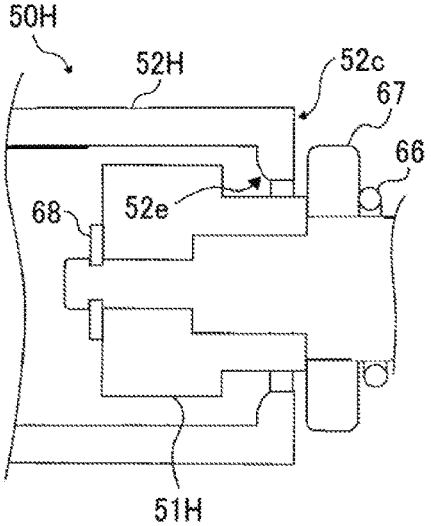
FIG. 39 is an enlarged view illustrating a main part of a screw joint according to Variation 8.

FIG. 39 is an enlarged view illustrating a main part of a screw joint 50H according to Variation 8.

In Variation 8, a rounded corner 52*e* at the leading end of the retaining portion 52*c* on the near side (the left side of FIG. 39) of the image harming apparatus 100 facing the output projections 151*c*. The rounded corner 52*e* is a chamfered edge and has a curved surface with the inner diameter gradually increasing from the far side toward the near side of the image forming apparatus 100.

Figure 40A:
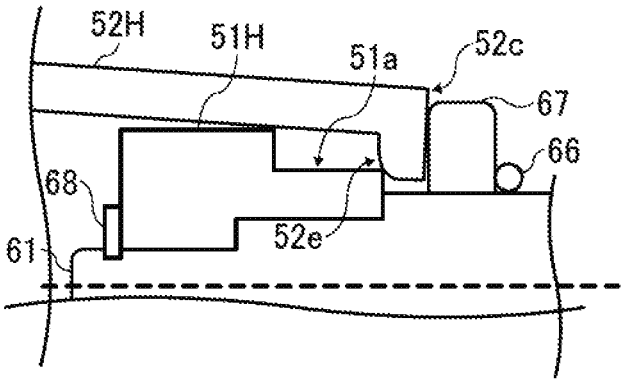
FIG. 40A is a diagram illustrating a state in which the intermediate member according to Variation 8 moves toward a drive coupling position while the intermediate member is being inclined.
Figure 40B:
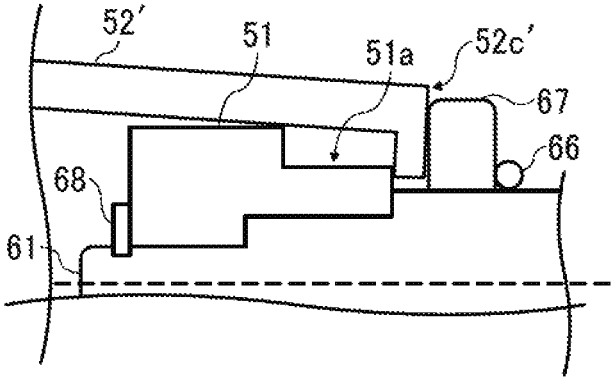
FIG. 40B is a diagram illustrating a state in which an intermediate member having the retaining portion with no chamfered edge moves toward a drive coupling position while the intermediate member is being inclined.

FIG. 40A is a diagram illustrating a state in which an intermediate member 52H according to Variation 8 moves toward a drive coupling position while the intermediate member 52H is being inclined. FIG. 40B is a diagram illustrating a state in which an intermediate member 52' having a retaining portion 52*c'* with no chamfered edge moves toward a drive coupling position while the intermediate member 52H is being inclined.

There are cases that the length of a gap between a retaining portion and the tubular portion of a screw output joint is smaller than the specific length of a gap due to manufacturing error. In such cases, due to axis misalignment between the drive output shaft 61 and the shaft 143*b* of the developer supply screw 43*b* when the intermediate member 52' moves to a drive coupling position by the biasing force of the spring 66 while being inclined, the leading end of the retaining portion may contact the end portion of the tubular portion of the screw output joint, as illustrated in FIG. 40B.

As illustrated in FIG. 40B, in a case in which the retaining portion 52*c'* of the intermediate member 52' does not have a chamfered edge at the leading end on the near side of the image forming apparatus 100 facing the output projections, when the leading end of the retaining portion 52*c'* contacts the end portion of the tubular portion 51*a* of the screw output joint 51, the retaining portion 52*c'* cannot climb over the tubular portion 51*a*. As a result, the intermediate member 52' does not move to the drive coupling position, and the intermediate member 52' and the screw input joint 53 cannot be drivingly coupled with each other.

By contrast, in Variation 8, as illustrated in FIG. 40A, the rounded corner 52*e* of the retaining portion 52*c* of the intermediate member 52H contacts the end portion of the tubular portion 51*a*. According to this contact of the rounded corner 52*e* of the retaining portion 52*c* with the end portion of the tubular portion 51*a*, a component force of the biasing force of the spring 66 to bias the intermediate member 52H toward the near side of the image forming apparatus 100 is applied to move a direction in which the retaining portion 52*c* climbs over the tubular portion 51*a*. As a result, the retaining portion 52*c* climbs over the tubular portion 51*a*, and the intermediate member 52H moves to the drive coupling position by the biasing force of the spring 66. Accordingly, even when the length of the gap between the retaining portion 52*c* and the tubular portion 51*a* of a screw output joint 51H is relatively smaller than the specific length of a gap due to manufacturing error, the intermediate member 52H and the screw output joint 51H can be drivingly coupled with each other reliably.

Figure 41:
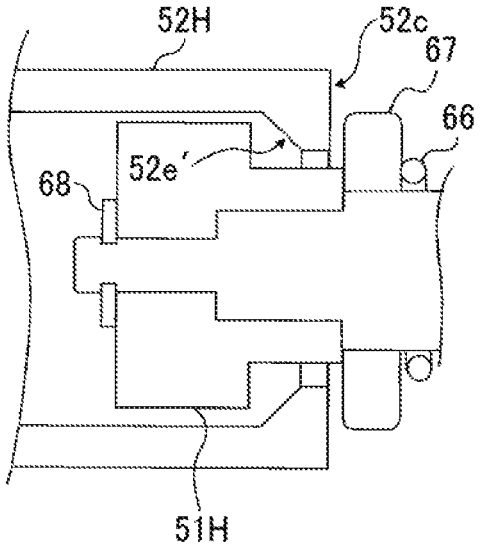
FIG. 41 is an enlarged view illustrating a main part of the screw joint of Variation 8, in which the retaining portion includes an inclined surface on the near side of a leading end thereof disposed facing the output projection.

Further, FIG. 41 is an enlarged view illustrating a main part of the screw joint 50H of Variation 8, in which the retaining portion 52*c* includes a sloped surface 52*e*' as a chamfered edge with the inner diameter gradually increasing from the far side toward the near side of the image forming apparatus 100. According to this configuration, even when the retaining portion 52*c* contacts the end portion of the tubular portion 51*a*, the retaining portion 52*c* climbs over the tubular portion 51*a*, and the intermediate member 52H and the screw input joint 53H can be drivingly coupled with each other reliably.

Further, the end portion of the tubular portion of the screw output joint 53H may be a curved surface or a sloped surface with the outer diameter gradually increasing from the near side of the image forming apparatus 100 toward the far side of the image forming apparatus 100. According to this configuration, even when the retaining portion 52*c* contacts the end portion of the tubular portion of the screw output joint 53H, the retaining portion 52*c* climbs over the tubular portion, and the intermediate member 52H and the screw input joint 53H can be drivingly coupled with each other reliably.

In the above-described embodiment and variations, a screw joint (i.e., the screw joints 50 and 50A through 50H) is employed. However, the joint is not limited to the screw joint. For example, the joint used in the configurations illustrated in FIGS. 6 through 41 can also be the brush roller joint such as the lubricant applying brush roller 45*a*. Further, the joint used in the configurations illustrated in FIGS. 6 through 41 can also be the developing joint that drivingly couples the developing roller 43*a* and the drive device on the side of the apparatus body of the image forming apparatus 100. By providing the developing joint for the configurations illustrated in FIGS. 6 through 41, if there is axis misalignment between the shaft of the developing roller 43*a* and the drive output shaft of the drive device on the side of the apparatus body of the image forming apparatus 100, the reaction force at the shaft of the developing joint can be restrained. According to the configurations including the developing joint, the deviation of development gap between the photoconductor 41 and the developing roller 43*a* and the deviation of gap between the developing roller 43*a* and the development doctor 43*c* can be restrained. The nonuniformity of rotation of the developing roller 43*a* due to axis misalignment can also be restrained. Consequently, the image density nonuniformity caused by the deviation of development gap, the deviation of gap to the development doctor 43*c*, and the nonuniformity of rotation of the developing roller 43*a* can be restrained.

Further, the joint used in the configurations illustrated in FIGS. 6 through 41 can also be a joint that may correspond to a gear mounted on the shaft of the developer supply screw 43*b* on the near side of the image thrilling apparatus 100 to mesh with a developer stirring gear that is mounted on a shaft of the developer stirring screw 43*h* and with a developer discharging gear that is mounted on a shaft of the developer discharge screw 43*j*.

The joint used in the configurations illustrated in FIGS. 6 through 41 can also be a joint that drivingly couples the shaft of the belt cleaning brush roller 17*a* of the belt cleaning device 17 and the drive device on the side of the apparatus body of the image forming apparatus 100. By providing the joint that drivingly couples the shaft of the belt cleaning brush roller 17*a* and the drive device on the side of the apparatus body of the image forming apparatus 100 for the configurations illustrated in FIGS. 6 through 41, the nonuniformity of rotation of the belt cleaning brush roller 17*a* and the deviation of contact pressure of the belt cleaning brush roller 17*a* to the intermediate transfer belt 11 caused by the reaction force to the joint can be restrained. Consequently, the load variation influence from the belt cleaning brush roller 17*a* to the intermediate transfer belt 11 can be reduced, and the speed fluctuation of the intermediate transfer belt 11 can be reduced.

The configurations according to the above-descried embodiments are not limited thereto. This disclosure can achieve the following aspects effectively.

Aspect 1.

A drive transmission device (for example, the screw drive transmission device 60) includes an output body (for example, the screw output joint 51), an input body (for example, the screw input joint 53), and an intermediate body (for example, the intermediate member 52). The output body is disposed on a side of a drive source and has a drive output portion (for example, the output external gear 51*c*, the output projections 151*c*). The input body is disposed on a side of a rotary body and has a drive input portion (for example, the input external gear 53*a*, the input projections 153*a*). The intermediate body has a cylindrical shape and is supported by a support side body being one of the output body and the input body. The intermediate body includes a relay portion (for example, the internal gear 52*a*, the relay projections 152*a*) and a retaining portion (for example, the retaining portion 52*c*). The relay portion is disposed on an inner circumferential surface of the intermediate body and is configured to receive a driving force applied by the drive output portion of the output body and to transmit the driving force to the drive input portion of the input body. The retaining portion is disposed facing a drive transmission portion of the support side body in an axial direction of the intermediate body and is configured to prevent the intermediate body from falling from the support side body. A distance from a center of rotation of the intermediate body to a leading end of the retaining portion is greater than or equal to a distance from the center of rotation of the intermediate body to a leading end of the relay portion.

In order to reduce the size of the intermediate body, it is preferable to reduce the thickness of the intermediate body. However, in order to ensure the strength of the intermediate body, the intermediate body is preferable to have a certain thickness. Further, in order to absorb axis alignment of the input body and the output body, it is also preferable that the intermediate body is tiltable by a predetermined angle to the axial direction. In order to make the intermediate body incline by the predetermined angle to the axial direction, it is preferable to have a predetermined gap between the leading end of the retaining portion and the outer circumferential surface of the body facing the leading end of the retaining member in the radial direction of the input body and the output body.

Accordingly, when "A" represents the outer diameter of the opposing body facing the leading end of the retaining portion, where the opposing body faces the retaining body, in the radial direction, "B" represents the gap between the leading end of the retaining portion and the body facing the leading end of the retaining portion in the radial direction, "C" represents the length from the leading end of the retaining portion to the inner circumferential surface of the intermediate body, "D" represents the thickness of the intermediate body, and "E" represents the outer diameter of the intermediate body that can tilt by the predetermined angle and is used to obtain a predetermined strength, the outer diameter E can be specified with an equation of $E=(B+C+D)\times 2+A$.

It is to be noted that the gap B between the leading end of the retaining portion and the member facing the leading end of the retaining portion in the radial direction is not limited to tiltable by the predetermined angle to the axial direction. However, for example, in order to make the assembly of the drive transmission device easier, the gap B is provided between the leading end of the retaining portion and the member facing the leading end of the retaining portion in the radial direction.

In Aspect 1, the distance from the center of rotation of the intermediate body to the leading end of the retaining portion is greater than the center of rotation of the intermediate body to the leading end of the relay portion. Therefore, the retaining portion is located, in the radial direction, at the same position as the leading end of the relay portion or more recessed or shorter than the leading end of the relay portion. Accordingly, when compared with a comparative configuration in which the leading end of the retaining portion is projected greater than the leading end of the relay portion, the configuration in Aspect 1 can make the length C from the leading end of the retaining portion to the inner circumferential surface of the intermediate body can be shorter or smaller.

Accordingly, when compared with the comparative drive transmission device, the configuration according to this disclosure can reduce the size of the intermediate body, and therefore can reduce the size of the drive transmission device.

Aspect 2.

In Aspect 1, the drive transmission device (for example, the screw drive transmission device 60) further includes a biasing body (for example, the spring 66) configured to bias the intermediate body (for example, the intermediate member 52) toward a drive coupling position at which the driving force is transmittable between the output body (for example, the screw output joint 51) and the input body (for example, the screw input joint 53) via the intermediate body. The intermediate body is supported by the support side body and is operable to axially move from the drive coupling position toward a direction separating from an opposite side body being one of the output body and the input body different from the support side body and not supporting the intermediate body.

According to this configuration, as described in the above-described embodiment, in a state in which the rotation phase of the external tooth of the opposite side body (for example, the input projections 153*a* of the screw input joint 53 in the above-described embodiment) is matched with the rotation phase of the relay portion (for example, the relay projections 152*a*) of the intermediate body, when the rotary body is attached to the apparatus body of the image forming apparatus, the drive transmission portion of the opposite side body contacts the relay portion, and therefore the drive transmission portion of the opposite side body does not enter into the intermediate body. However, in Variation 2, since the intermediate body can move in the direction separating from the opposite side body, the drive transmission portion of the opposite body contacts the relay portion. Therefore, even if the drive transmission portion of the opposite side body does not enter into the intermediate body, the intermediate body slides along the axial direction, so that the rotary body can be attached to the apparatus body of the image forming apparatus. As the phase in the rotation direction of the drive transmission portion of the opposite side body and the phase in the rotation direction of the relay portion become unmatched and the drive transmission portion of the opposite side body and the relay portion are released from the connection, the intermediate body moves to the drive coupling position at which the intermediate body and the opposite side body are drivingly coupled with each other by the biasing force applied by the biasing body (for example, the spring 66). Consequently, the drive transmission portion of the opposite side body enters into the intermediate body, so that the intermediate body can be drivingly coupled with the opposite side body.

Further, the distance from the center of rotation of the intermediate body to the leading end of the retaining portion is greater than or equal to the distance from the center of rotation of the intermediate body to the leading end of the relay portion. Accordingly, when compared with the configuration in which the retaining portion is projected beyond the relay portion. When the intermediate body moves to the drive coupling position, the output body can be prevented from being contacted by the retaining portion. As a result, even if the outer diameter of the intermediate body is reduced, occurrence of an event that the intermediate body does not reach the drive coupling position can be restrained.

Aspect 3.

In Aspect 2, the biasing body (for example, the spring 66) applies a biasing force operable not to affect the intermediate body (for example, the intermediate member 52) when the intermediate body is located at the drive coupling position. (For example, in the configuration of the above-described embodiment, the slide member 67 can move in the axial direction between the spring 66 and the intermediate member 52 and contact the end portion of the support side body (for example, the screw output joint 51).)

According to this configuration, as described in the above-described embodiment, the intermediate body can be inclined to the axial direction smoothly, and therefore axis misalignment and angular misalignment can be absorbed preferably. Accordingly, occurrence of the reaction force and an increase in rotation nonuniformity of the rotary body can be restrained preferably.

Aspect 4.

In Aspect 2 or Aspect 3, the retaining portion includes a chamfered edge (for example, the rounded corner 52*e* and the sloped face 52*e*') at an end portion on a side of the drive transmission portion of the support side body. The chamfered edge is one of a sloped face and a curved face, having an inner diameter increasing toward the drive transmission portion of the support side body.

According to this configuration, as described in Variation 8, in a case in which the gap between the leading end of the retaining portion and the portion facing the retaining portion is reduced due to manufacturing error, even if the retaining portion contacts the end portion of the output body (for example, the screw output joint 51) during movement of the intermediate body to the drive coupling position, the retaining portion can climb over the output body. Accordingly the intermediate body can be moved to the drive coupling position by the biasing force of the biasing body (for example, the spring 66) reliably, and therefore the intermediate body and the opposite side body (for example, the screw input joint 53) can be drivingly coupled with each other reliably.

Aspect 5.

In any one of Aspect 1 through Aspect 4, the intermediate body (for example, the intermediate member 52) has a predetermined clearance in a radial direction and a rotational direction of the intermediate body, to the input body (for example, the screw input joint 53) and the output body (for example, the screw output joint 51).

According to this configuration, as described in the above-described embodiment, the intermediate body can be moved and inclined to the axial direction. Accordingly, the intermediate body and the opposite side body can be drivingly coupled with each other preferably. Further, the axial misalignment and the angular misalignment can be absorbed preferably, and therefore the reaction force and the rotation nonuniformity of the rotary body can be restrained.

Aspect 6.

In Aspect 5, the predetermined gap in the radial direction is provided between the retaining portion (for example, the retaining portion 52*c*) and an opposing body facing the leading end of the retaining portion in the radial direction, between an inner circumferential surface of the intermediate body (for example, the intermediate member 52) and the drive output portion of the output body (for example, the screw output joint 51), between the inner circumferential surface of the intermediate body and the drive input portion of the input body (for example, the screw input joint 53), between the relay portion (for example, the internal gear 52*a*, the relay projections 152*a*) and an outer circumferential surface of the output body, between the relay portion and an outer circumferential surface of the input body (for example, the screw input joint 53). The predetermined gap in the rotational direction is provided between the relay portion and the drive input portion of the input body and between the relay portion and the drive output portion of the output body.

According to this configuration, as described in the above-described embodiment, the intermediate body has the predetermined clearance in the radial direction and in the rotational direction to the input body and the output body.

Aspect 7.

In any one of Aspect 1 through Aspect 6, a projection (for example, the projections 52*d*) is provided on at least one of an opposing portion of the retaining portion (for example, the retaining portion 52*c*) facing the drive transmission portion of the support side body and an opposing portion of the drive transmission portion of the support side body facing the retaining portion.

According to this configuration, as described in Variation 7, when the intermediate body is inclined, one of the drive transmission portion of the support side body and the retaining portion contact the projection. Accordingly, even if the drive transmission portion of the support side body and the retaining portion contact with each other, the inclination of the intermediate body is not hindered, and the axial misalignment can be absorbed preferably. As a result, the reaction force and the rotation nonuniformity of the rotary body can be restrained preferably.

Aspect 8.

In any one of Aspect 1 through Aspect 7, at least one of a contact face to which the drive output portion of the output body (for example, the screw output joint 51) contacts the relay portion (for example, the internal gear 52*a*, the relay projections 152*a*) during drive transmission and a contact face to which the drive input portion of the input body (for example, the screw input joint 53) contacts the relay portion dining drive transmission is a circularly curved surface in the axial direction.

According to this configuration, as described in the above-described embodiment and Variation 1, when compared with the configuration in which the contact face is a flat face, the intermediate body can be inclined smoothly, and therefore the axial misalignment and the angular misalignment can be absorbed preferably.

Aspect 9.

In any one of Aspect 1 through Aspect 8, at least one of a contact face to which the drive output portion of the output body (for example, the screw output joint 51) contacts the relay portion during drive transmission and a contact face to which the drive input portion of the input body (for example, the screw input joint 53) contacts the relay portion during drive transmission is a circularly curved surface in a radial direction.

According to this configuration, as described in Variation 3, when compared with the configuration in which the contact face is a flat face, the intermediate body can be inclined smoothly, and therefore the axial misalignment and the angular misalignment can be absorbed preferably.

Aspect 10.

In Aspect 8 or Aspect 9, both Young's modulus of the input body (for example, the screw input joint 53) having the contact face of the drive output portion with the circularly curved surface and Young's modulus of the output body (for example, the screw output joint 51) having the contact face of the drive input portion with the circularly curved surface are greater than Young's modulus of the intermediate body (for example, the intermediate member 52).

According to this configuration, as described in Variation 1, wear on the circularly curved surface can be restrained, and therefore the intermediate body can be inclined smoothly over the long period of time.

Aspect 11.

In any one of Aspect 1 through 7, at least one of the drive output portion of the output body (for example, the screw output joint 51) and the drive input portion of the input body (for example, the screw input joint 53) has an axially linear face perpendicular to a rotational direction.

According to this configuration, as described in Variation 3, a parting line is not set at the center in the axial direction of the contact face contacting the relay portion during the drive transmission, and occurrence of burr on the contact face can be prevented. Further, the output body and the input body can be molded using a pair of molds moving in the axial direction. As a result, the cost for molds can be decreased, and a reduction in manufacturing cost can be achieved.

Aspect 12.

In any one of Aspect 1 through Aspect 11, at least one of the drive input portion of the input body (for example, the screw input joint 53) and the drive output portion of the output body (for example, the screw output joint 51) is a gear.

According to this configuration, as described in the above-described embodiment, meshing of the gears can perform drive transmission.

Aspect 13.

In Aspect 12, a thickness of each tooth of the gear is thickest at a center in the axial direction and gradually reduces toward both ends in the axial direction.

According to this configuration, as described with reference to FIG. 14, when compared with a configuration in which the thicknesses of teeth of the gear are the same, the intermediate body can be moved smoothly, and therefore axial misalignment and angular misalignment can be absorbed preferably.

Aspect 14.

In Aspect 1 through Aspect 13, at least one of a shape of the drive output portion (for example, the output external gear 51*c*) of the output body (for example, the screw output joint 51) and the drive input portion (for example, the input external gear 53*a*) of the input body (for example, the screw input joint 53) and a number of the drive output portion of the output body and the drive input portion of the input body is different from each other.

According to this configuration, as described in Variation 6, when the output body disposed on the side of the apparatus body that cannot be easily replaced includes a body having high strength (for example, the parallel pin), and the input body (for example, the screw input joint) disposed on the side of the rotary body that can be replaced easily includes a body having low strength (for example, a resin material), if the number and shape of the drive input portion of the input body is the same as the number and shape of the drive output portion of the output body, the drive input portion of the input body is likely to be damaged or broken. However, by setting at least one of the number and shape of the drive output portion of the output body and the number and shape of the drive input portion of the input body different from each other, even if the input body has lower strength than the output body, occurrence of damage or breakage of the drive input portion of the input body can be restrained.

Aspect 15.

In Aspect 14, the relay portion (for example, the internal gear 52*a*, the relay projections 152*a*) of the intermediate body (for example, the intermediate member 52) includes a tapered drive transmission portion having a surface inclined toward the axial direction of the intermediate body. A length of the drive output portion of the output body (for example, the screw output joint 51) in the rotational direction and a length of the drive input portion of the input body (for example, the screw input joint 53) in the rotational direction are different from each other, and an engaging portion of the relay portion to engage with the drive output portion of the output body and an engaging portion of the relay portion to engage with the drive input portion of the input body are connected by the tapered drive transmission portion.

According to this configuration, as described with reference to FIG. 36, when the intermediate body is attached to the support side body, the drive transmission portion of the support side body is not caught by the connecting portion at which the engaging portion of the relay portion to engage with the drive output portion of the output body and the engaging portion of the relay portion to engage with the drive input portion of the input body are connected. Accordingly, the intermediate body can be attached to the support side body smoothly.

Further, when the intermediate body moves to the drive coupling position, the drive transmission portion of the support side body is not caught by the connecting portion at which the engaging portion of the relay portion to engage with the drive output portion of the output body and the engaging portion of the relay portion to engage with the drive input portion of the input body. Accordingly, the intermediate body can move to the drive coupling position smoothly, and the intermediate body and the opposite side body can be drivingly coupled with each other.

Aspect 16.

In Aspect 1 through Aspect 15, the intermediate body (for example, the intermediate member 52) is supported by the support side body and is operable to axially move from the drive coupling position toward a direction separating from an opposite side body. The opposite side body is one of the output body (for example, the screw output joint 51) and the input body (for example, the screw input joint 53) different from the support side body and not supporting the intermediate body. The opposite side body includes multiple drive transmission portions (for example, the input projections 153*a*), one of the multiple drive transmission portions having an extended portion extending greater than the rest of the multiple drive transmission portions toward the support side body. An end portion of the extended portion on a side of the support side body has a tapered shape with an outer diameter decreasing toward the side of the support side body.

According to this configuration, as described in Variation 4 with reference to FIGS. 27 through 29, the one of the multiple drive transmission portions having the extended portion enters the intermediate body before the rest of the multiple drive transmission portions do. Accordingly, even if the screw joint has a relatively large axis misalignment, the drive transmission portions of the opposite side bodies disposed adjacent to each other in the rotational direction can be prevented from entering the same groove between the relay portions. Accordingly, the drive transmission portion of the opposite side body can be prevented from being damaged or broken.

Further, the end portion of the extended portion on the side of the support side body has a tapered shape having an outer diameter decreasing toward the support side body. Accordingly, as described with reference to FIG. 29, the movement of inclination of the intermediate body can be prevented from being hindered by the leading end of the extended portion.

Aspect 17.

In Aspect 1 through Aspect 16, an outer diameter of the intermediate body (for example, the intermediate member 52) is smaller than or equal to twice an outer diameter of an output shaft (for example, the drive output shaft 61) on which the output body (for example, the screw output joint 51) is mounted.

According to this configuration, when compared with a configuration in which the outer diameter of the intermediate body exceeds twice the outer diameter of the drive output shaft, the drive transmission device (for example, the screw joint 50) can be installed in a relatively narrow gap.

Aspect 18.

In Aspect 1 through Aspect 17, the support side body is the output body (for example, the screw output joint 51).

According to this configuration, as described in the above-described embodiment, when compared with the case in which the intermediate body (for example, the intermediate member 52) is supported by the input body (for example, the screw input joint 53), this configuration can reduce the number of parts of the rotary body to be replaced regularly. As a result, an increase in cost of the rotary body can be restrained, and therefore the cost of maintenance of the image forming apparatus can also be restrained.

Aspect 19.

An image forming apparatus (for example, the image forming apparatus 100) includes a rotary body (for example, the developer supply screw 43*b*), and the chive transmission device (for example, the screw drive transmission device 60) according to any one of Aspect 1 through Aspect 18, configured to transmit the driving force from the drive source to the rotary body.

According to this configuration, the reaction force of the shaft of the rotary body and the rotation nonuniformity of the rotary body can be restrained.

Aspect 20.

In Aspect 19, at least one of a lubricant applying brush roller, a developing roller, and a developer stirring screw is driven for drive transmission using the drive transmission device according to any one of Aspect 1 through Aspect 18.

According to this configuration, as described in the above-described embodiment, good images with image non-uniformity being restrained can be produced by the image forming apparatus.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive transmission device comprising:

a rotary shaft to rotate by a driving force of a drive source;

a first rotary body disposed on an axial end of the rotary shaft, to rotate with the rotary shaft, the first rotary body being tubular and having a first external gear on a portion of an outer circumference of the first rotary body;

an intermediate body being tubular and having a first opening at one axial end and a bottom wall portion with a second opening at another axial end, the intermediate body having, on an inner circumference of the intermediate body, an internal gear to mesh with the first external gear of the first rotary body;

a second rotary body inserted from the first opening into the intermediate body, to rotate with a driven body, the second rotary body being tubular and having, on an outer circumference of the second rotary body, a second external gear to mesh with the internal gear of the intermediate body, a diameter of the second opening being smaller than a tooth tip circle diameter of the first external gear of the first rotary body and greater than an outer diameter of the first rotary body.

2. The drive transmission device according to claim 1, wherein, when the first rotary body and the intermediate body are moved in opposite directions to each other from a state in which the first rotary body is inserted to the intermediate body, an end of the first external gear on a side of the second opening of the intermediate body contacts the bottom wall portion of the intermediate body.

3. The drive transmission device according to claim 2, wherein the end of the first external gear on the side of the second opening of the intermediate body directly contacts a part of the bottom wall portion of the intermediate body in which the internal gear is not formed.

4. The drive transmission device according to claim 1, wherein the outer diameter of the first rotary body is substantially equal to a tooth bottom circle diameter of the first external gear.

5. The drive transmission device according to claim 1, further comprising:

a first bearing and a second bearing to support the rotary shaft;

a biasing member disposed between the first rotary body and the second bearing; and a ring member supported by the rotary shaft between the first rotary body and the biasing member.

6. The drive transmission device according to claim 5, wherein the outer diameter of the first rotary body is greater than an outer diameter of the rotary shaft, wherein the ring member contacts an end of the first rotary body on the side of the second opening of the intermediate body.

7. The drive transmission device according to claim 6, wherein, in a state in which the ring member is in contact with the end of the first rotary body on the side of the second opening of the intermediate body, a gap between the ring member and the first external gear of the first rotary body in an axial direction of the rotary shaft is greater than a thickness of the bottom wall portion of the intermediate body in the axial direction of the rotary shaft.

8. The drive transmission device according to claim 5, wherein an outer diameter of the ring member is greater than the outer diameter of the first rotary body.

9. The drive transmission device according to claim 5, wherein an outer diameter of the ring member is smaller than at least an outer diameter of the second bearing.

10. The drive transmission device according to claim 5, wherein an outer diameter of the intermediate body is smaller than at least an outer diameter of the second bearing.

11. The drive transmission device according to claim 1, wherein a tooth thickness of an end portion of the internal gear of the intermediate body on a side of the first opening gradually decreases in toward the first opening.

12. The drive transmission device according to claim 1, wherein a tooth thickness of a leading end portion of the second external gear of the second rotary body gradually decreases toward a leading end of the second external gear.

13. The drive transmission device according to claim 1, wherein a thickness of a tooth of at least one gear of the first external gear, the internal gear, and the second external gear is greatest at a center in an axial direction of the rotary shaft and decreases toward both ends in the axial direction of the rotary shaft.

14. The drive transmission device according to claim 1, wherein an outer diameter of the intermediate body is smaller than or equal to twice an outer diameter of the rotary shaft.

15. An image forming apparatus comprising:

the driven body; and the drive transmission device according to claim 1, configured to transmit the driving force of the drive source to the driven body.

16. The image forming apparatus according to claim 15, wherein the drive transmission device transmits the driving force to at least one of a lubricant applying device, a developing device, a developing roller, a developer stirring screw, and a cleaning device.

* * * * *